US012486098B2

(12) United States Patent
Welle

(10) Patent No.: US 12,486,098 B2
(45) Date of Patent: Dec. 2, 2025

(54) THERMALLY INSULATING HOLDER FOR DISPOSABLE BEVERAGE CUPS

(71) Applicant: Richard Patrick Welle, Sunset Beach, CA (US)

(72) Inventor: Richard Patrick Welle, Sunset Beach, CA (US)

( * ) Notice: Subject to any disclaimer, the term of this patent is extended or adjusted under 35 U.S.C. 154(b) by 100 days.

(21) Appl. No.: 18/489,550

(22) Filed: Oct. 18, 2023

(65) Prior Publication Data

US 2024/0043196 A1 Feb. 8, 2024

Related U.S. Application Data

(63) Continuation-in-part of application No. 17/697,785, filed on Mar. 17, 2022, now Pat. No. 11,827,440, and a continuation-in-part of application No. 17/541,613, filed on Dec. 3, 2021, now Pat. No. 11,820,580, which is a continuation of application No. 17/214,814, filed on Mar. 27, 2021, now Pat. No. 11,225,369, application No. 18/489,550 is a continuation-in-part of application No. 17/541,613, filed on Dec. 3, 2021, now Pat. No. 11,820,580, which is a continuation of application No. 17/214,814, filed on Mar. 27, 2021, now Pat. No. 11,225,369.

(60) Provisional application No. 63/011,780, filed on Apr. 17, 2020.

(51) Int. Cl.
*B65D 81/38* (2006.01)
*A47G 23/02* (2006.01)

(52) U.S. Cl.
CPC ..... *B65D 81/3876* (2013.01); *A47G 23/0216* (2013.01); *A47G 2023/0283* (2013.01); *B65D 2543/00046* (2013.01)

(58) Field of Classification Search
CPC ..... B65D 81/3876; B65D 81/3879; B65D 81/3881; B65D 81/3886; A47G 23/02; A47G 23/0208; A47G 23/0216; A47G 23/0266; A47G 23/04; A47G 2023/0275; A47G 2023/0283; A47G 2023/0291
See application file for complete search history.

(56) References Cited

U.S. PATENT DOCUMENTS 3,766,975 A * 10/1973 Todd ..... A47G 19/2288 165/47
4,974,741 A * 12/1990 Gustafson ..... B65D 81/3886 D7/511
5,022,235 A * 6/1991 Grissom ..... B65D 81/3886 62/530

(Continued)

*Primary Examiner* — Javier A Pagan
(74) *Attorney, Agent, or Firm* — Sheppard, Mullin, Richter & Hampton, LLP; Jaime D. Choi

(57) ABSTRACT

An insulating holder is provided for a conventional disposable beverage cup. The insulating holder includes an upward-facing flange that supports the beverage cup at its peripheral bead and without interfering with a disposable lid that may be fitted to the cup by snap fit over the peripheral bead. The insulating holder further includes a retaining mechanism that holds the disposable cup and lid in the holder without interfering with the ability of the user to drink from the cup. The insulating holder further includes means to facilitate insertion of the cup into the holder without requiring the user to hold the cup either by its bead or by the lid.

17 Claims, 28 Drawing Sheets

(56) References Cited

U.S. PATENT DOCUMENTS

| | | | | |
|---|---|---|---|---|
| 6,367,652 | B1 * | 4/2002 | Toida | B65D 25/2811 220/592.16 |
| D830,788 | S * | 10/2018 | Petrillo | D7/624.2 |
| 10,974,889 | B2 * | 4/2021 | Callinan | B65D 81/3886 |
| 2015/0122828 | A1 * | 5/2015 | Madala | A47G 23/0266 220/592.17 |

* cited by examiner

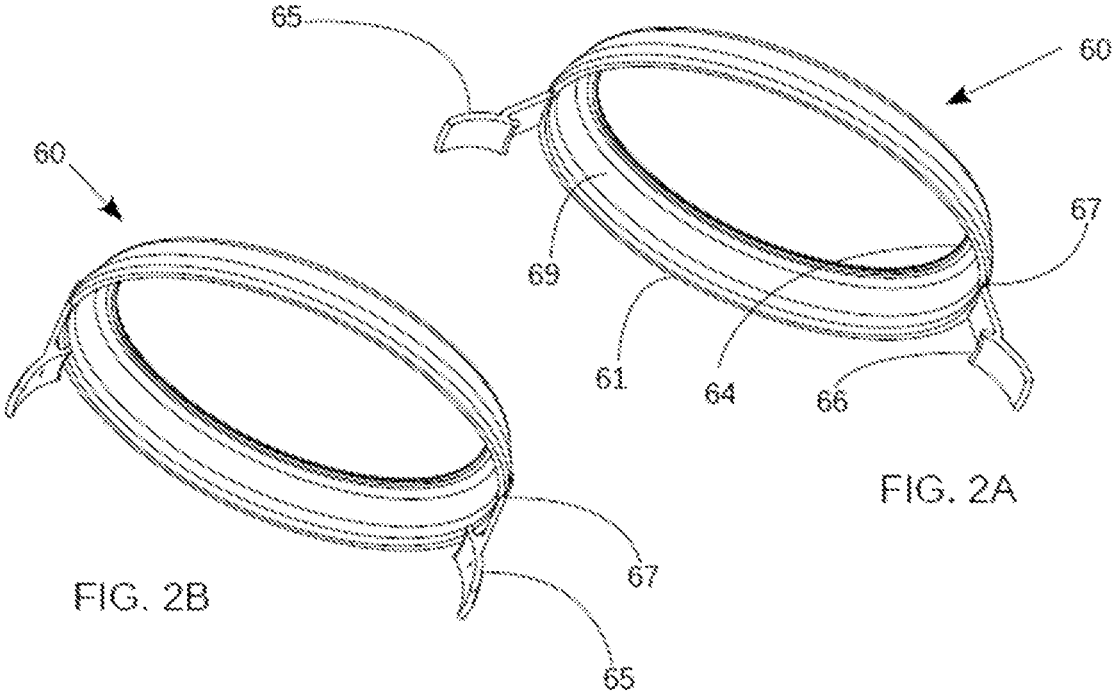
FIG. 2A
FIG. 2B
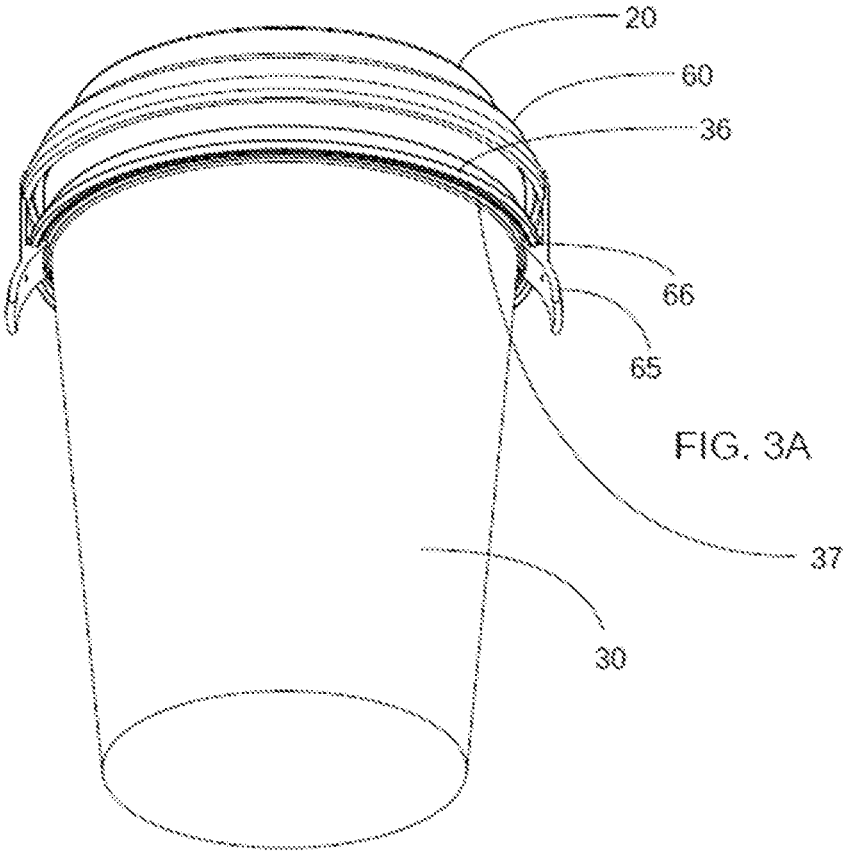
FIG. 3A

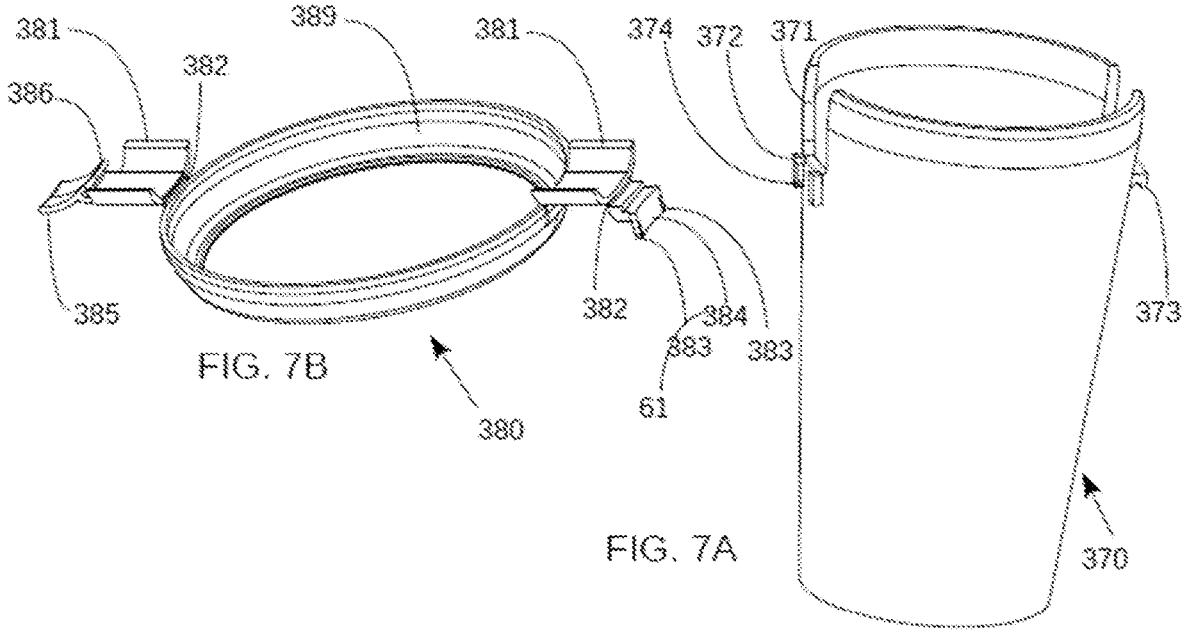
FIG. 7B
FIG. 7A
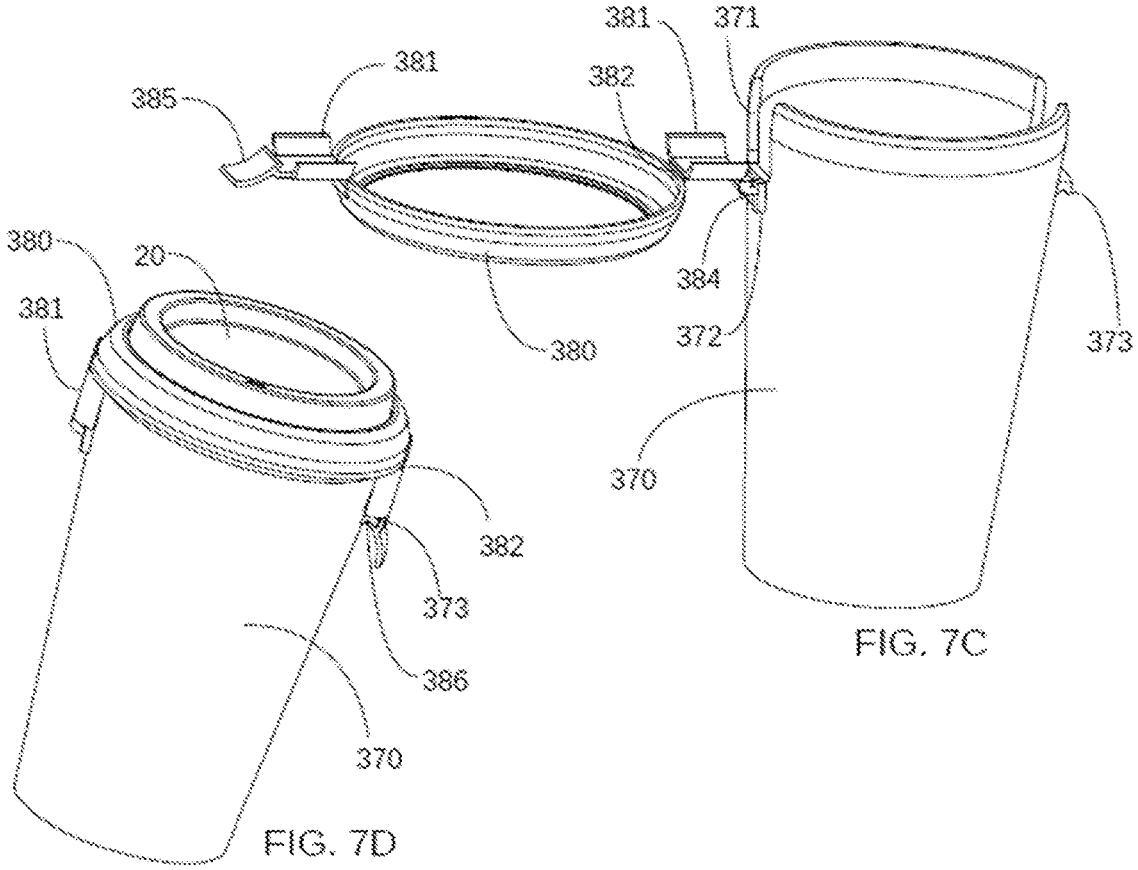
FIG. 7C
FIG. 7D

THERMALLY INSULATING HOLDER FOR DISPOSABLE BEVERAGE CUPS

CROSS-REFERENCE TO RELATED APPLICATIONS

This application is a continuation-in-part under 35 U.S.C. § 120 of U.S. patent application Ser. No. 17/697,785, filed on Mar. 17, 2022, which is a continuation-in-part under 35 U.S.C. § 120 of U.S. patent application Ser. No. 17/541,613, filed on Dec. 3, 2021, which is a continuation under 35 U.S.C. § 120 of U.S. patent application Ser. No. 17/214,814, filed on Mar. 27, 2021, now U.S. Pat. No. 11,225,369, which claims the benefit of U.S. Provisional Patent Application No. 63/011,780, filed Apr. 17, 2020, the entire contents of each of which applications is incorporated by reference herein.

This application also is a continuation-in-part under 35 U.S.C. § 120 of U.S. patent application Ser. No. 17/541,613, filed on Dec. 3, 2021, which is a continuation under 35 U.S.C. § 120 of U.S. patent application Ser. No. 17/214,814, filed on Mar. 27, 2021, now U.S. Pat. No. 11,225,369, which claims the benefit of U.S. Provisional Patent Application No. 63/011,780, filed Apr. 17, 2020, the entire contents of each of which applications is incorporated by reference herein.

FIELD

The present invention relates to cup holders, and more specifically, to insulating cup holders for disposable beverage cups.

BACKGROUND OF THE INVENTION

Reusable insulating beverage containers, often called travel mugs, are vessels that include inner and outer shells separated from one another by a vacuum or other insulating space. An opening at the top allows beverages to be introduced into the inner shell and consumed therefrom. The top opening is often provided with a secure lid that can be closed to prevent accidental spillage of the beverage during handling and transport of the mug. The insulating quality of such travel mugs ensures that a beverage introduced into the inner shell can maintain a temperature, whether hot or cold, substantially different from the temperature of the surrounding environment for an extended period of time in comparison to uninsulated beverage containers.

While such travel mugs can be conveniently filled with beverages in a home setting, their utility for beverages sold over the counter, such as specialty coffees, is limited because vendors of such beverages are often not willing to dispense such beverages directly into personal travel mugs. Indeed, vendors may be prohibited by regulation from dispensing directly into such travel mugs for health reasons. Furthermore, when a travel mug is used, it is often preferable to clean the mug before reuse, which may not be convenient for travel mugs kept, for example, in automobiles for beverage consumption while driving.

Over-the-counter beverages, such as specialty coffees, are typically sold in uninsulated disposable plastic or paper cups, which are often provided with disposable lids to prevent spillage. It is known, however, that such lids can be unreliable because the fit between the lid and the cup, typically a snap fit between a radially-outward-extending peripheral bead on the cup and a corresponding recess in the lid, depends on consistent manufacture and consistent application by the beverage vendor after the cup is filled. If the lid is not properly attached to the cup it can leak or become dislodged, resulting in spillage of the beverage.

Toida et al. (U.S. Pat. No. 6,367,652) disclosed an insulating cup holder into which a disposable beverage cup can be inserted, thereby providing the thermal insulating capability of a travel mug for use with a disposable beverage cup. However, the cup holder disclosed by Toida et al. included an unbroken upward-facing flange on the side wall to support the cup through contact with the underside of the peripheral bead on the cup. In this configuration, it is not possible for the user's fingers to remain in contact with the outside of the disposable cup, except with the peripheral bead if the disposable lid is not yet attached, while the cup is being fully inserted into the cup holder. As such, if the lid is attached, it would be necessary to hold the cup by the lid for insertion into the insulating holder, posing a risk that the lid would come off during the insertion process, thereby potentially spilling the beverage if the cup is filled with a beverage at the time it is inserted into the cup holder. Alternatively, if the lid is not yet attached, it would be necessary to hold the cup by the bead as it is inserted. This may be problematic since the bead is typically not large enough to provide a reliable hold on the cup, again posing a risk of spilling the beverage. Furthermore, the design of Toida et al. did not include provisions for securing the lid or cup in place once the cup was inserted into the holder.

The present invention is directed to overcoming one or more of the above deficiencies in the prior art.

BRIEF SUMMARY OF THE INVENTION

Some examples herein provide an improved holder for a disposable beverage cup. Some examples herein provide an insulated holder for a disposable beverage cup. Some examples herein provide a holder for a disposable beverage cup wherein the disposable beverage cup can be manually inserted fully into the holder while maintaining contact with the outer surface of the cup. Some examples herein provide a holder for a disposable beverage cup wherein the disposable beverage cup and lid can be secured within the cup holder.

Illustratively, an insulating holder is provided herein that is configured to securely contain a disposable beverage cup while limiting the flow of heat to or from the contents of the cup. Disposable beverage cups typically have an inverted frustoconical side wall, a closed bottom, and an upper opening surrounded by a radially-outwardly-extending peripheral bead sized to be mated with a corresponding peripheral groove in a disposable lid by means of a snap fit. The insulating holder of the present disclosure may be or include a vessel with insulating walls having an upper access opening shaped to receive the disposable beverage cup, with the top edge of the holder side wall abutting the bottom of the peripheral bead.

In some examples, a cup holder includes an insulating vessel for accepting a disposable beverage cup and a retaining mechanism for securely holding the cup and lid in the holder when in use.

In some examples, the side wall of the cup holder includes two or more gaps sized to allow the cup to be held by the side wall below the lid with two or more fingers while inserting the cup into the holder.

In some examples, the retaining mechanism is secured by means of a snap fit.

In some examples, the retaining mechanism is secured by means of a threaded connection.

In some examples, the retaining mechanism is secured by means of a magnetic connection.

In some examples, the retaining mechanism is secured by means of a rotary clamp connection.

In some examples, the retaining mechanism is configured to cover the two or more gaps when the retaining mechanism is secured to the insulating cup holder.

In some examples, the retaining mechanism comprises one or more retractable clamps that provide a downward force on the shoulder of the lid.

In some examples, insertion of the cup into the insulating cup holder is facilitated by a cup support ring.

In some examples, the retaining mechanism is semi-permanently attached to the cup holder and hinged to allow it to rotate and allow insertion or removal of a cup from the cup holder.

In some examples, the retaining mechanism includes a modified disposable lid.

In some examples, a drinking port cover is provided to minimize the potential for spilling the contents of the cup.

In some examples, an electrical resistance heater is provided to maintain the contents of the cup at a temperature above that of the environment.

In some examples, a thermoelectric element is provided to maintain the contents of the cup at a temperature above or below that of the environment.

In some examples, the holder is a double-walled vessel with an evacuated gap between the walls to reduce or minimize heat flow.

Some examples herein provide an assembly for holding a beverage cup. The assembly may include a cup holder including a closed bottom, a generally cylindrical or frustoconical side wall, and an upper access opening configured to receive the beverage cup. An outer surface of the side wall of the cup holder includes a latch-engagement feature. The assembly also may include a retainer including a retaining ring, a skirt, a latch, and a hinge. The latch is configured to engage the latch-engagement feature.

In some examples, the side wall of the cup holder includes an upward facing flange configured to support the peripheral bead. In some examples, the side wall and the flange of the cup holder include two or more gaps sized to allow a user to hold a beverage cup with two or more fingers while inserting the beverage cup into the cup holder. In some examples, the skirt covers the two or more gaps.

Some examples herein provide an assembly for holding a beverage cup. The assembly includes a cup holder including a closed bottom, a generally cylindrical or frustoconical side wall, and an upper access opening configured to receive the beverage cup. An outer surface of the side wall of the cup holder includes at least one latch-engagement feature. The assembly also includes a retainer including a retaining ring, a skirt, first and second latches, and first and second hinges respectively movably coupling the first and second latches to the skirt. The retainer is couplable to the cup holder by engaging the first and second latches with the latch-engagement feature and is removable from the cup holder by disengaging the first and second latches from the latch-engagement feature.

In some examples, the at least one latch-engagement feature includes at least one recess. In some examples, the at least one recess is downward-facing. In some examples, the first and second latches include first and second latch hooks that respectively insert into the at least one recess.

In some examples, the at least one latch-engagement feature encircles the cup holder and defines a single recess with which the first and second latches both engage. In some examples, the at least one latch-engagement feature is segmented and defines first and second recesses with which the first and second latches respectively engage.

In some examples, the side wall of the cup holder includes first and second gaps sized to allow a user to hold the beverage cup with first and second fingers while inserting the beverage cup into the cup holder. In some examples, the first and second latches respectively cover the first and second gaps when the retainer is coupled to the cup holder. In some examples, the skirt includes first and second skirt extensions that respectively cover the first and second gaps when the retainer is coupled to the cup holder. In some examples, the side wall of the cup holder further includes a third gap sized to allow a user to further hold the beverage cup with a third finger while inserting the beverage cup into the cup holder. In some examples, the first gap is larger than the second gap.

In some examples, the first and second hinges include living hinges.

Some examples herein provide a cup holder for holding a beverage cup. The cup holder includes a closed bottom; a generally cylindrical or frustoconical side wall; and an upper access opening configured to receive the beverage cup. An outer surface of the side wall of the cup holder includes at least one latch-engagement feature configured to engage first and second latches of a retainer.

In some examples, the at least one latch-engagement feature includes at least one recess. In some examples, the at least one recess is downward-facing. In some examples, the at least one recess is configured to having inserted therein first and second latch hooks of the first and second latches. In some examples, the at least one latch-engagement feature encircles the cup holder and includes a single recess configured to engage with both the first and second latches. In some examples, the at least one latch-engagement feature includes first and second recesses configured to respectively engage with the first and second latches.

In some examples, the side wall of the cup holder includes first and second gaps sized to allow a user to hold the beverage cup with first and second fingers while inserting the beverage cup into the cup holder. In some examples, the side wall of the cup holder further includes a third gap sized to allow a user to further hold the beverage cup with a third finger while inserting the beverage cup into the cup holder. In some examples, the first gap is larger than the second gap.

Some examples herein provide a retainer for use with a cup holder. The retainer includes a retaining ring; a skirt; first and second latches; and first and second hinges respectively movably coupling the first and second latches to the skirt. The retainer is couplable to the cup holder by engaging the first and second latches with at least one latch-engagement feature of the cup holder and is removable from the cup holder by disengaging the first and second latches from the at least one latch-engagement feature.

In some examples, the at least one latch-engagement feature includes at least one recess. In some examples, the first and second latches include first and second latch hooks that respectively insert into the at least one recess.

In some examples, the side wall of the cup holder includes first and second gaps sized to allow a user to hold the beverage cup with first and second fingers while inserting the beverage cup into the cup holder. In some examples, the first and second latches respectively are configured to cover the first and second gaps when the retainer is coupled to the cup holder. In some examples, the skirt includes first and second skirt extensions that respectively are configured to cover the first and second gaps when the retainer is coupled to the cup holder.

In some examples, the first and second hinges include living hinges.

Some examples herein provide an assembly for holding a beverage cup. The assembly includes a cup holder including a closed bottom, a generally cylindrical or frustoconical side wall, and an upper access opening configured to receive the beverage cup. An outer surface of the side wall of the cup holder includes a latch-engagement feature. The assembly also includes a retainer including a retaining ring, a skirt, a latch, a first hinge movably coupling the latch to the skirt, and a second hinge movably coupling the retainer to the cup holder. The latch engages the latch-engagement feature to put the retainer in a first, closed position and disengages from the latch-engagement feature to put the retainer in a second, open position.

In some examples, the outer surface of the side wall of the cup holder includes a structural feature; and the retainer includes a retainer attachment interface that engages the structural feature to couple the retainer to the cup holder. Some examples further include a third hinge between the retainer attachment interface and the skirt.

In some examples, the retainer further includes an attachment ring coupled to the skirt via the second hinge and configured to slide onto the cup holder from below.

In some examples, the latch-engagement feature includes a recess. In some examples, the recess is downward-facing. In some examples, the latch includes a latch hook that inserts into the recess. In some examples, the latch-engagement feature encircles the cup holder.

In some examples, the side wall of the cup holder includes first and second gaps sized to allow a user to hold the beverage cup with first and second fingers while inserting the beverage cup into the cup holder. In some examples, the latch covers the first gap when the retainer is in the first, closed position. In some examples, the skirt includes first and second skirt extensions that respectively cover the first and second gaps when the retainer is in the first, closed position. In some examples, the side wall of the cup holder further includes a third gap sized to allow a user to further hold the beverage cup with a third finger while inserting the beverage cup into the cup holder. In some examples, the first gap is larger than the second gap.

In some examples, the first and second hinges include living hinges.

Some examples herein provide a cup holder for holding a beverage cup. The cup holder includes a closed bottom; a generally cylindrical or frustoconical side wall; and an upper access opening configured to receive the beverage cup. An outer surface of the side wall of the cup holder includes a latch-engagement feature. The outer surface of the cup holder is configured to be coupled to a retainer. The latch-engagement feature is configured to engage a latch of the retainer.

In some examples, the outer surface of the cup holder includes a ring against which an attachment ring of the retainer is configured to be pressed, or a structural feature that engages a retainer attachment interface.

In some examples, the latch-engagement feature includes a recess. In some examples, the recess is downward-facing. In some examples, the recess is configured to receive a latch hook of the latch. In some examples, the latch-engagement feature encircles the cup holder.

In some examples, the side wall of the cup holder includes first and second gaps sized to allow a user to hold the beverage cup with first and second fingers while inserting the beverage cup into the cup holder. In some examples, the side wall of the cup holder further includes a third gap sized to allow a user to further hold the beverage cup with a third finger while inserting the beverage cup into the cup holder. In some examples, the first gap is larger than the second gap.

Some examples herein provide a retainer for use with a cup holder. The retainer includes a retaining ring; a skirt; a latch; a first hinge movably coupling the latch to the skirt; and a second hinge movably coupling the retainer to the cup holder. The latch is configured to engage a latch-engagement feature of the cup holder to put the retainer in a first, closed position and to disengage from the recess to put the retainer in a second, open position.

Some examples further include a retainer attachment interface configured to engage a structural feature of the cup holder to couple the retainer to the cup holder. Some examples further include a third hinge between the retainer attachment interface and the skirt.

Some examples further include a ring coupled to the skirt via the second hinge and configured to slide onto the cup holder from below.

In some examples, the latch includes a latch hook configured to insert into a recess of the latch-engagement feature. In some examples, the side wall of the cup holder includes first and second gaps sized to allow a user to hold the beverage cup with first and second fingers while inserting the beverage cup into the cup holder. In some examples, the latch is configured to cover the first gap when the retainer is in the first, closed position. In some examples, the skirt includes first and second skirt extensions respectively configured to cover the first and second gaps when the retainer is in the first, closed position.

In some examples, the first and second hinges include living hinges.

Some examples herein provide an assembly for holding a beverage cup. The assembly includes a cup holder including a closed bottom, a generally cylindrical or frustoconical side wall, and an upper access opening configured to receive the beverage cup. An outer surface of the side wall of the cup holder includes at least one latch-engagement feature. The assembly includes a lid including a skirt, first and second latches, and first and second hinges respectively movably coupling the first and second latches to the skirt. The lid is couplable to the cup holder by engaging the first and second latches with the at least one latch-engagement feature and is removable from the cup holder by disengaging the first and second latches from the at least one latch-engagement feature.

In some examples, the at least one latch-engagement feature includes at least one recess. In some examples, the at least one recess is downward-facing. In some examples, the first and second latches include first and second latch hooks that respectively insert into the at least one recess.

In some examples, the at least one latch-engagement feature encircles the cup holder and is configured to be engaged by both the first and second latches. In some examples, the at least one latch-engagement feature is segmented and includes first and second segments that are configured to be respectively engaged by the first and second latches.

In some examples, the side wall of the cup holder includes first and second gaps sized to allow a user to hold the beverage cup with first and second fingers while inserting the beverage cup into the cup holder. In some examples, the first and second latches respectively cover the first and second gaps when the retainer is coupled to the cup holder.

In some examples, the skirt includes first and second skirt extensions that respectively cover the first and second gaps when the retainer is coupled to the cup holder. In some examples, the side wall of the cup holder further includes a third gap sized to allow a user to further hold the beverage cup with a third finger while inserting the beverage cup into the cup holder. In some examples, the first gap is larger than the second gap.

In some examples, the first and second hinges include living hinges.

Some examples herein provide a lid for use with a cup holder. The lid includes a skirt; first and second latches; and first and second hinges respectively movably coupling the first and second latches to the skirt. The lid is couplable to the cup holder by engaging the first and second latches with at least one latch-engagement feature of the cup holder and is removable from the cup holder by disengaging the first and second latches from the at least one latch-engagement feature.

In some examples, the at least one latch-engagement feature includes at least one recess, and the first and second latches include first and second latch hooks that respectively insert into the at least one recess.

In some examples, the side wall of the cup holder includes first and second gaps sized to allow a user to hold the beverage cup with first and second fingers while inserting the beverage cup into the cup holder. In some examples, the first and second latches respectively are configured to cover the first and second gaps when the lid is coupled to the cup holder. In some examples, the skirt includes first and second skirt extensions that respectively are configured to cover the first and second gaps when the lid is coupled to the cup holder.

In some examples, the first and second hinges include living hinges.

BRIEF DESCRIPTION OF DRAWINGS

FIG. 2A shows a perspective view of a retainer with latches in the open position.

FIG. 2B shows a perspective view of a retainer with latches in the closed position.

FIG. 3A shows a perspective view of the cup holder of FIG. 1A assembled with a disposable cup and lid and secured with a retainer, as seen from below.

FIG. 7A shows a perspective view of a cup holder with a semi-permanent attachment point for a retainer.

FIG. 7B shows a perspective view of a retainer configured to be semi-permanently attached to the cup holder of FIG. 7A.

FIG. 7C shows a perspective view of a cup holder with a retainer semi-permanently attached in the open position.

FIG. 7D shows a perspective view of a cup holder with a semi-permanent retainer, assembled with a cup and lid.

DETAILED DESCRIPTION OF THE INVENTION

As will be described with reference to FIGS. 1A-1C, 2A-2B, 3A-3C, 4A-4F, 5A-5B, 6A-6D, 7A-7D, 8A-8G, 9A-9D, 10A-10C, 11A-11E, 12A-12E, 13A-13E, 14A-14B, 15A-15C, 16A-16C, 17A-17C, 18A-18F, 19, 20A-20F, 21A-21G, 22A-22C, 23, and 24, provided herein are improved cup holders, retainers, lids, and assemblies of two or more of such elements, which may be used to securely hold a beverage cup in a user-friendly manner. For example, the present cup holders, retainers, lids, and assemblies may include removable retainers, or retainers secured to a cup holder via hinges and/or latch-engagement features that allow a beverage cup to be conveniently secured within a cup holder and released from the cup holder with reduced risk of the retainer becoming lost or inadvertently dislodged from the cup holder. Illustratively, some examples herein provide an assembly for holding a beverage cup that includes a cup holder and a retainer. The cup holder may include a closed bottom, a generally cylindrical or frustoconical side wall, and an upper access opening configured to receive the beverage cup, wherein an outer surface of the side wall of the cup holder includes features that engage with a removable retaining ring, and/or a latch-engagement feature. The retainer may include retaining ring, a skirt, a latch, and a hinge, wherein the latch is configured to engage the latch-engagement feature.

Figure 1A:
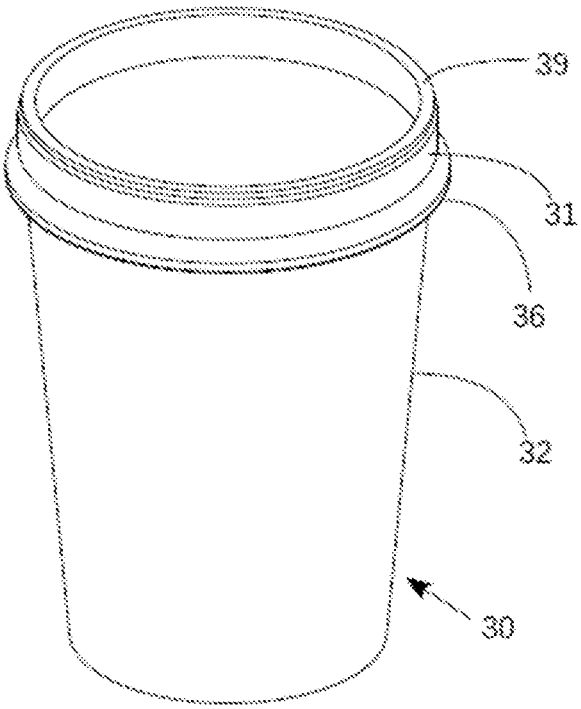
FIG. 1A shows a perspective view of a cup holder with a latch-engagement feature.
Figure 1B:
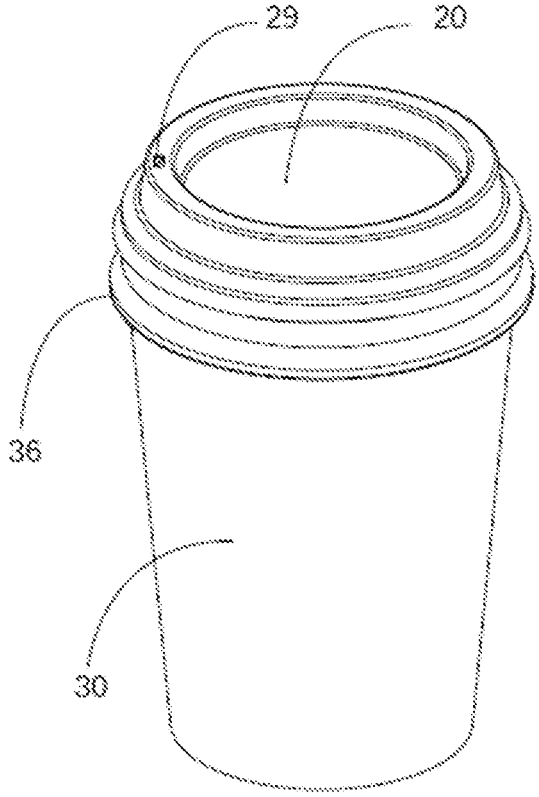
FIG. 1B shows a perspective view of the cup holder of FIG. 1A assembled with a disposable cup and lid.
Figure 1C:
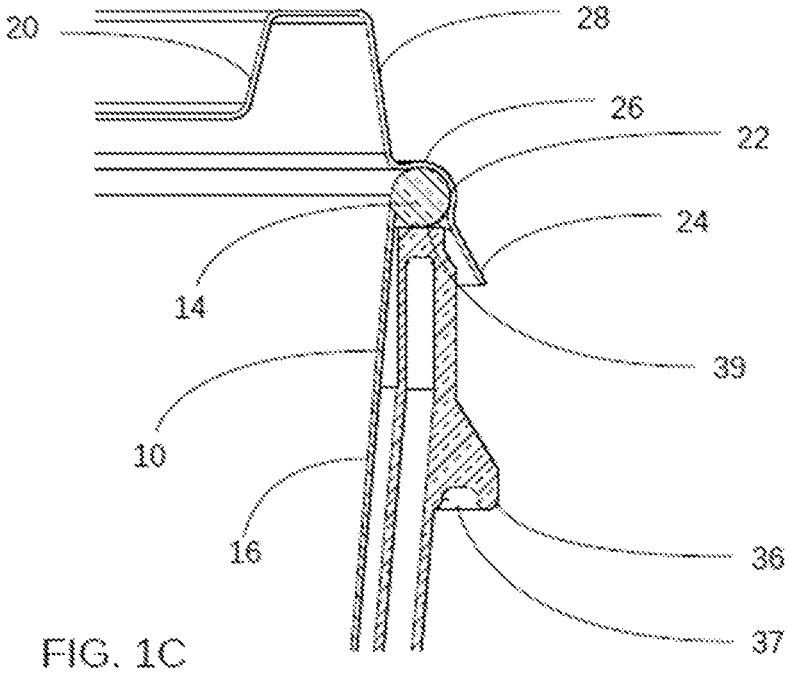
FIG. 1C shows a cross-section view of a portion of the assembly of FIG. 1B.

Illustratively, an example holder for a disposable beverage cup is illustrated in FIGS. 1A through 1C. The illustrated assembly is seen to include a conventional, disposable beverage cup 10, a conventional disposable lid 20, and a cup holder 30. Cup 10 may be made of plastic, paper, or paper coated with materials such as plastic or wax, depending on the nature of the beverage for which it is intended. The cup walls 16 take the shape of an inverted truncated cone, with generally flat and parallel top and bottom. At the upper end, the cup includes a radially-outwardly-extending peripheral bead 14, which provides structural rigidity to the circular upper opening of the cup, and provides a mating interface for a disposable lid. As illustrated in FIGS. 1B and 1C, conventional disposable lid 20 includes a radially-inwardly-opening circumferential groove 22 configured to mate through a snap fit with peripheral bead 14 of disposable cup 10, and a shoulder 26 that rests on the top of peripheral bead 14 when lid 20 is properly mated with disposable cup 10. Disposable lid 20 also includes a peripheral skirt 24 below peripheral groove 22, such that the skirt provides a guiding surface to assist in aligning the disposable lid for mating on bead 14 of disposable cup 10. Disposable lid 20 also includes a neck 28 leading to an elevated section containing a drinking port 29.

Cup holder 30 includes a closed bottom, generally cylindrical or frustoconical side wall, and an upper access opening configured to receive the beverage cup. Illustratively, cup holder 30 includes a wall 32 substantially in the form of a truncated inverted cone open at the top and closed at the bottom by a generally flat bottom surface. Near its top, wall 32 includes a short, substantially-cylindrical section 31 and ends in an upward-facing circular flange 39 configured to support cup 10 at the underside of peripheral bead 14. The inner diameter of upward-facing flange 39 is preferably greater than or equal to the diameter of side wall 16 of disposable beverage cup 10 at the level of the bottom of bead 14 but less than the diameter of a circle that follows the center of peripheral bead 14 around the top of cup 10. Further, the outer diameter of upward-facing flange 39 is preferably greater than the diameter of a circle that follows the center of peripheral bead 14 around the top of cup 10, but also less than the inner diameter of skirt 24 on disposable lid 20. These dimensional constraints ensure that bead 14 is able to rest securely but without interference on upward-facing flange 39 when beverage cup 10 with mating lid 20 are together inserted into cup holder 30. Alternatively, beverage cup 10 without lid 20 may be inserted into cup holder 30, with lid 20 being attached to cup 10 after insertion into cup holder 30.

According to some examples provided herein, as illustrated in FIG. 1C, cup holder 30 may be insulated to reduce or minimize heat transfer between the contents of cup 10 and the outside environment by providing a double wall and floor with either an insulating material disposed between the walls or evacuating the volume between the walls. The use of double walls in the figures of the present patent application is for illustration purposes only, and it will be understood that the system and methods described herein can equally be applied to single-walled cup holders.

According to some examples provided herein, disposable beverage cup 10 in combination with lid 20 may be retained within cup holder 30 by means of a releasable clamp. In examples such as will be described with reference to FIGS. 1A-1C, 2A-2B, 3A-3C, 4A-4F, 5A-5B, 6A-6D, 7A-7D, 8A-8G, 10A-10C, 11A-11E, 12A-12E, 13A-13E, 14A-14B, 15A-15C, 16A-16C, 17A-17C, 19, and 21A-21G, the releasable clamp may be provided in a retainer, such as a retaining ring. In examples such as will be described with reference to FIGS. 9A-9D, and 19, the releasable clamp may be provided in a lid. In examples such as will be described with reference to FIGS. 18A-18F, and 20A-20F the releasable clamp may be provided in clamping mechanism fixed to the outer wall of the cup holder.

The retainer may include a retaining ring, a skirt, first and second latches, and first and second hinges respectively movably coupling the first and second latches to the skirt. For example, as shown in FIGS. 1A through 1C, outer wall 32 of cup holder 30 includes at least one latch-engagement feature 36 optionally including at least one recess, such as a downward-facing recess 37. FIGS. 2A and 2B illustrate a releasable clamp in the form of a retainer 60 having a ring shape (and thus may be referred to herein as a "retaining ring") with hinged latches 65 that can be used to detachably secure it to cup holder 30 by engaging the latches with the at least one latch-engagement feature 36. In some examples, retainer 60 includes an inward facing circumferential lobe 64 with an inner diameter not less than the outer diameter of neck 28 of disposable lid 20, and not more than the diameter of the circular line of contact between bead 14 and upward-facing flange 39. In the example illustrated in FIGS. 2A-2B, retainer 60 further includes a skirt 61 below inward-facing lobe 64. In some examples, the inner diameter of retainer skirt 61 is at least greater than the outer diameter of skirt 24 on lid 20 in order that retainer 60 may fit over skirt 24 without interference. Latches 65 may include a latch hook 66, and may be secured to retainer 60 by hinges 67 such as, for example, living hinges, configured to allow latches to rotate between non-latching (disengaged) and latching (engaged) positions, as illustrated in FIGS. 2A and 2B, respectively.

Figure 3C:
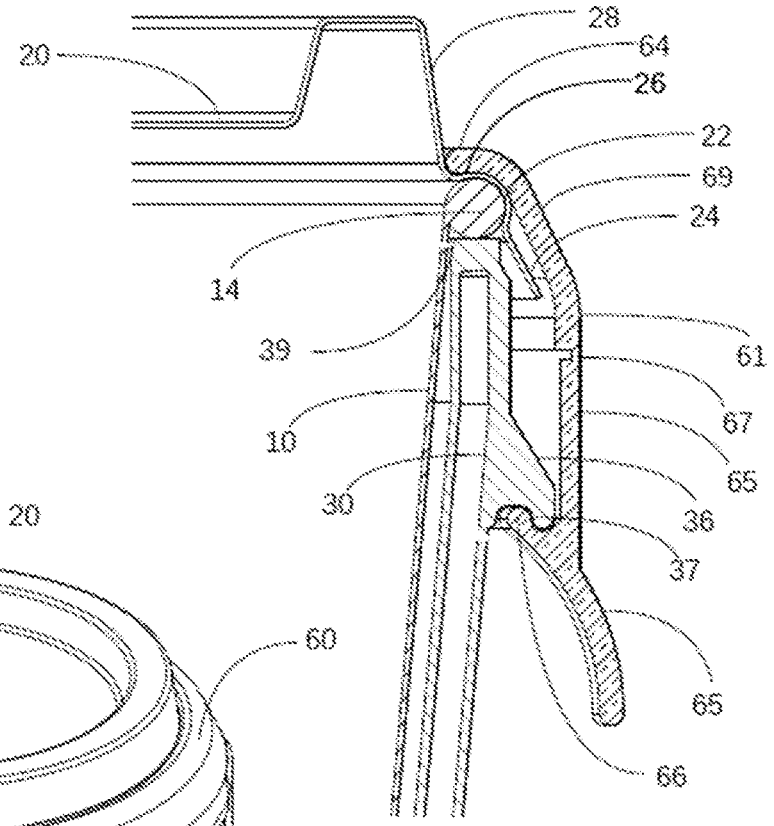
FIG. 3C shows a cross-section view of a portion of the assembly of FIG. 3B.
Figure 3B:
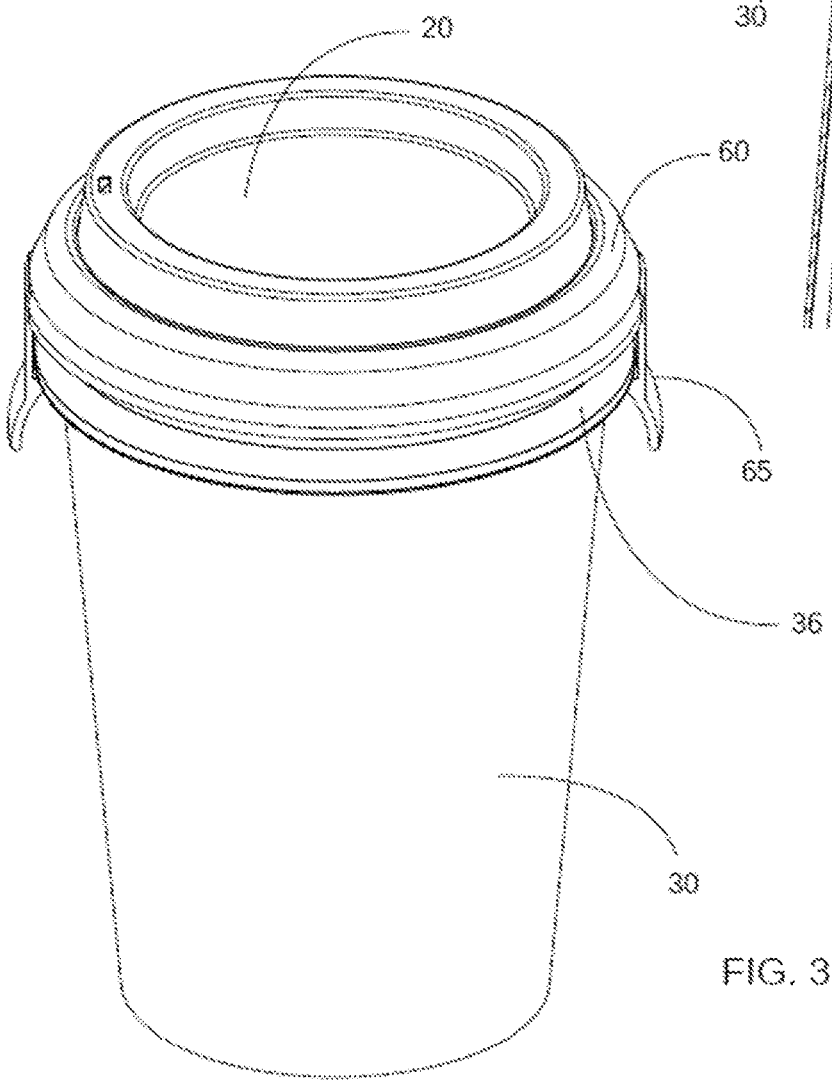
FIG. 3B shows a perspective view of the cup holder of FIG. 1A assembled with a disposable cup and lid and secured with a retainer, as seen from above.

The retainer 60 is couplable to the cup holder 30 by engaging the first and second latches 65 with the at least one latch engagement feature 36 and is removable from the cup holder by disengaging the first and second latches from the latch engagement feature. For example, FIGS. 3A through 3C illustrate the assembly of cup 10, lid 20, holder 30, and retainer 60. In the illustrated configuration, latch hooks 66 respectively engage with recess 37 in latch-engagement feature 36, holding retainer 60 securely on holder 30 and thereby securely containing cup 10 and lid 20 in holder 30 through the application of a downward force on shoulder 26 through bead 14 to upward-facing flange 39. In the nonlimiting example shown in FIGS. 1A through 1C, latch-engagement feature 36 is shown as completely encircling cup holder 30. The latch-engagement feature may include a single recess with which both first and second latches engage. It will be understood that a segmented latch-engagement feature (e.g., such as illustrated in FIGS. 4A-4F, 5A-5B, 6A-6D, 6A-7D, 8A-8G, 9C-9D, and 10A-10B) alternatively may be used. The segmented latch-engagement feature may include first and second recesses with which the first and second latches respectively engage. In such examples, the retainer may be oriented to ensure that the latch(es) align with usable portions of the latch-engagement feature.

According to examples such as illustrated in FIGS. 1A through 3C, upward-facing flange 39 may include an unbroken ring configured to interface with peripheral bead 14 of disposable beverage cup 10. When the flange is unbroken, as illustrated in FIG. 1A, it may be somewhat difficult to insert a beverage cup containing a liquid beverage into cup holder 30 without risk of spilling some liquid. This is because a user handling a filled beverage cup may find it easier and more secure to hold the cup by its side walls as opposed to holding the bead. While inserting a filled beverage cup into a cup holder 30 including an unbroken upward-facing flange, the user may find it necessary to hold the beverage cup by its peripheral bead while inserting the cup into cup holder 30. Further, if a filled beverage cup is covered with a disposable lid the bead is no longer accessible and insertion into cup holder 30 may require that the cup and lid combination be held by the lid, with the potential that the lid could detach from the bead and spill the contents of the cup. This is intended to be illustrated in FIG. 1B, where cup 10 with lid 20 have been inserted in holder 30, but no part of cup 10 is visible, indicating that the user may not be able to maintain contact with cup 10 while inserting the cup and lid combination into cup holder 30.

According to some examples provided herein, such as described with reference to FIGS. 4A-4F, 5A-5B, 6A-6D, 7A-7D, 8A-8F, 9C-9D, 10A-10C, 12A-12E, 13A-13E, 15A-15C, 16A-16C, 17A-17C, 18A-18F, 20A-20F, 22A-22F, 23, and 24, the side wall and flange of the cup holder may include two or more gaps sized to allow a user to hold a beverage cup with two or more fingers while inserting the beverage cup into the cup holder. In the nonlimiting example illustrated in FIGS. 4A through 4C, a cup holder 40 includes a wall 42 substantially in the form of a truncated inverted cone open at the top and closed at the bottom by a generally flat bottom surface. Near its top, wall 42 includes a short substantially cylindrical section 41 and ends in a segmented upward-facing circular flange 49 configured to support cup 10 at the underside of peripheral bead 14. The inner diameter of upward-facing flange 49 is preferably greater than or equal to the diameter of side wall 16 of disposable beverage cup 10 at the level of the bottom of bead 14. Further, the outer diameter of upward-facing flange 49 is preferably less than the inner diameter of skirt 24 on disposable lid 20. Upward-facing flange 49 is broken into segments separated by two gaps 48 extending downward into the upper part of wall 42 of cup holder 40. Gaps 48 are sized to allow a disposable cup 10 to be grasped between two or more fingers (where the term "fingers" is understood to include the thumb) as it is being inserted into cup holder 40, and to allow the grip on cup 10 to be maintained until cup 10 is fully inserted into cup holder 40 such that bead 14 is resting stably on segmented flange 49. Gaps 48 are sized to allow finger contact with the walls of disposable beverage cup 10 until the bead rests on segmented flange 49 even when disposable lid 20 is attached to disposable beverage cup 10. This is intended to be illustrated in FIG. 4C where cup 10 with lid 20 have been inserted in holder 40 and side wall 16 of cup 10 is visible through gap 48, indicating that the user would be able to maintain contact with the cup wall throughout the insertion process. Cup holder 40 further includes a latch-engagement feature 46 on the cylindrical section 41 of wall 42. Like upward-facing flange 49, latch-engagement feature 46 is segmented to allow clearance for insertion of the cup 10 in holder 40. After cup 10 with lid 20 is fully inserted into cup holder 40, retainer 60 may be attached, as illustrated in FIG. 4F, to prevent a filled beverage cup 10 from being easily dislodged from cup holder 40.

Figure 4A:
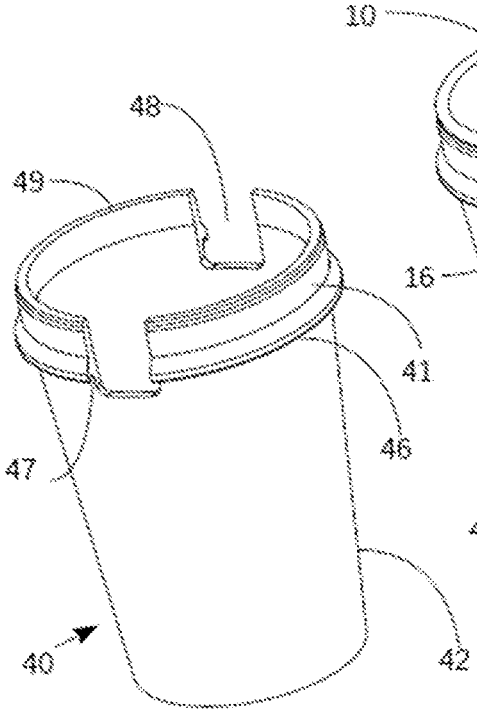
FIG. 4A shows a perspective view of a cup holder with finger-sized gaps in the upper wall, flange, and latch-retaining feature.
Figure 4B:
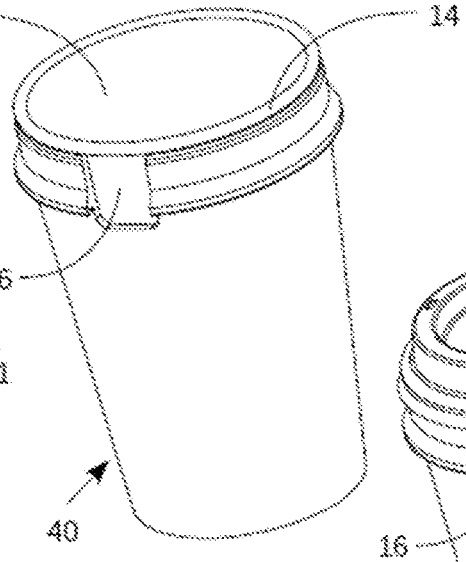
FIG. 4B shows a perspective view of the cup holder of FIG. 4A assembled with a cup.
Figure 4C:
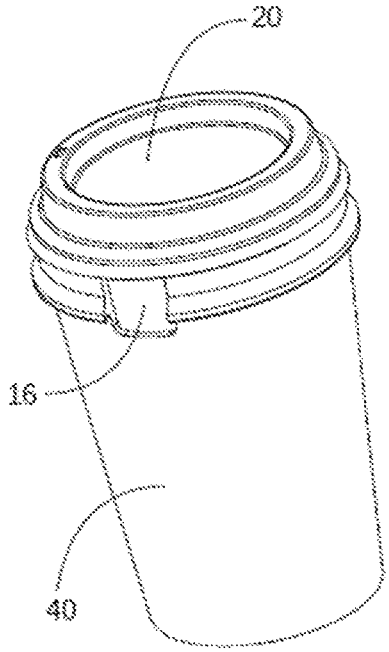
FIG. 4C shows a perspective view of the cup holder of FIG. 4A assembled with a cup and lid.
Figure 4D:
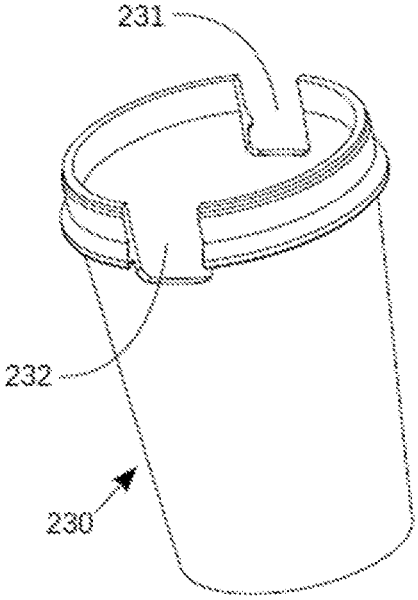
FIG. 4D shows a perspective view of a cup holder with finger-sized gaps of two different sizes.
Figure 4E:
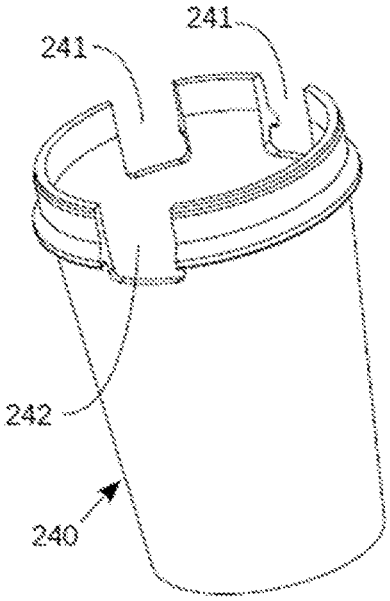
FIG. 4E shows a perspective view of a cup holder with three finger-sized gaps.
Figure 4F:
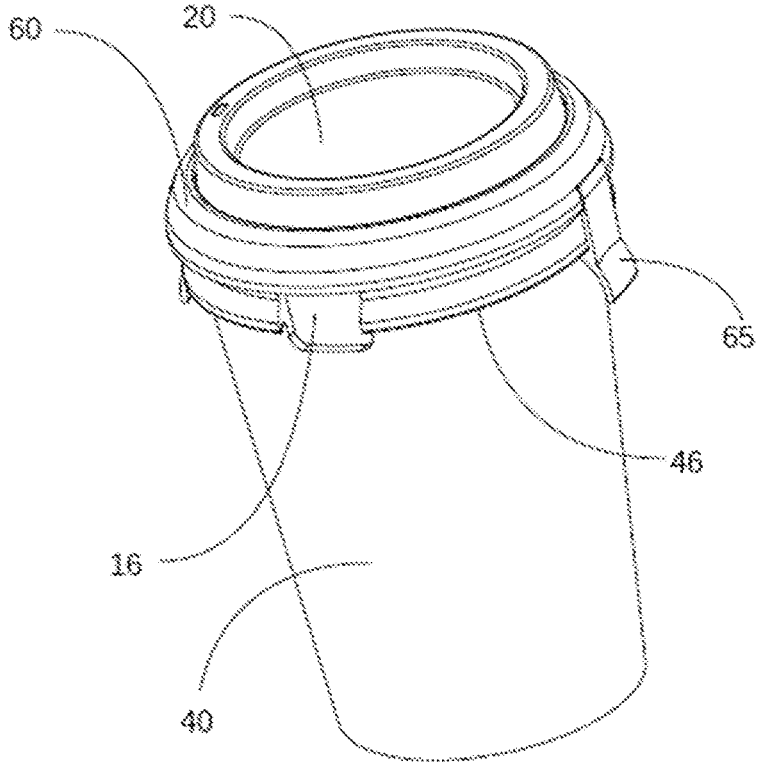
FIG. 4F shows a perspective view of the cup holder of FIG. 4A assembled with a cup, lid, and retainer.

In the example illustrated in FIG. 4A, gaps 48 may be of a uniform size. Alternatively, in the example illustrated in FIG. 4D, cup holder 230 may include two gaps 231 and 232 where one may be larger than the other to fit the thumb, which is typically larger than the other fingers. Further, in the example illustrated in FIG. 4E, cup holder 240 may include more than two gaps to facilitate more secure handling of cup 10 as it is inserted into cup holder 240. For example, gap 242 may be larger than gaps 241, where the arrangement of the gaps corresponds to preferred positions of thumb and two fingers when holding a cup from above. It will be appreciated that any examples provided herein suitably may be modified so as to include either an unbroken upper flange with no finger gaps; an upper flange and side wall which include two finger gaps; or an upper flange and side wall which include three or more finger gaps; and that any such finger gaps may be of a uniform size or may be differently sized.

Figure 5A:
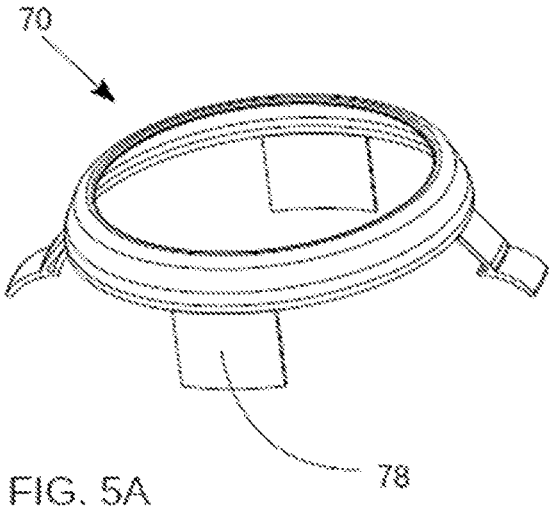
FIG. 5A shows a perspective view of retainer having skirt extensions to cover finger-sized gaps.
Figure 5B:
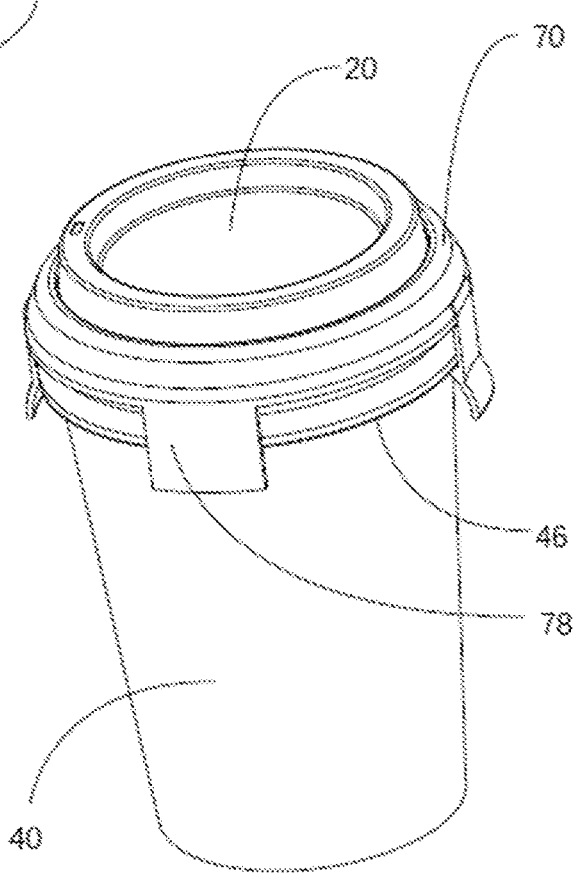
FIG. 5B shows a perspective view of the cup holder of FIG. 4A assembled with a cup, lid, and the retainer of FIG. 5A.
Figure 6A:
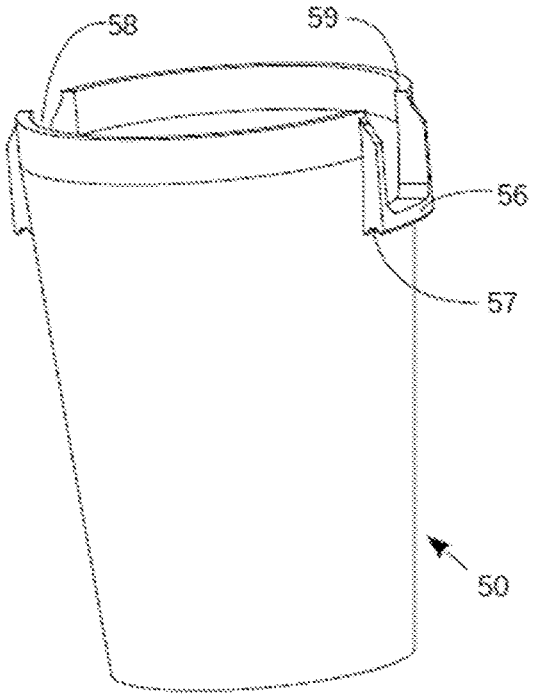
FIG. 6A shows a perspective view of a cup holder with finger-sized gaps in the upper wall and flange, and a latch-retaining feature below the gaps.
Figure 6B:
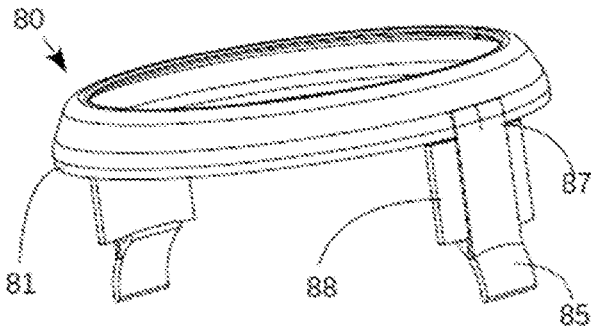
FIG. 6B shows a perspective view of a retainer configured to attach to the cup holder of FIG. 6A.
Figure 6C:
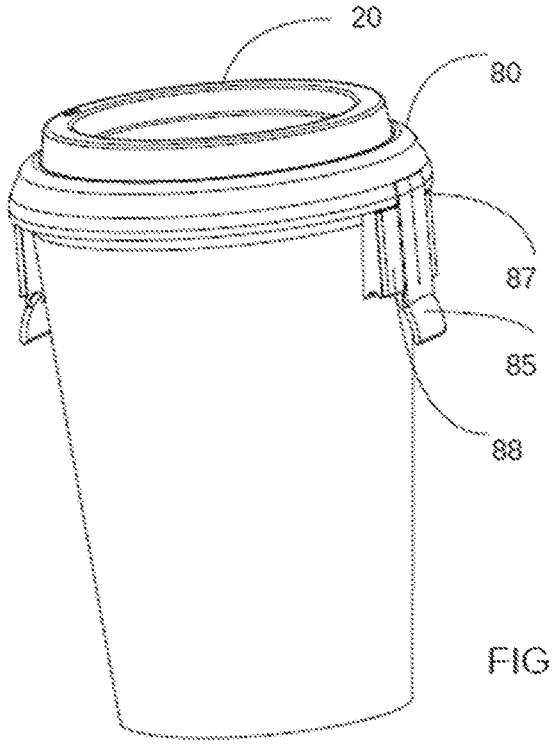
FIG. 6C shows a perspective view of the cup holder of FIG. 6A assembled with a cup, lid, and the retainer of FIG. 6B.
Figure 6D:
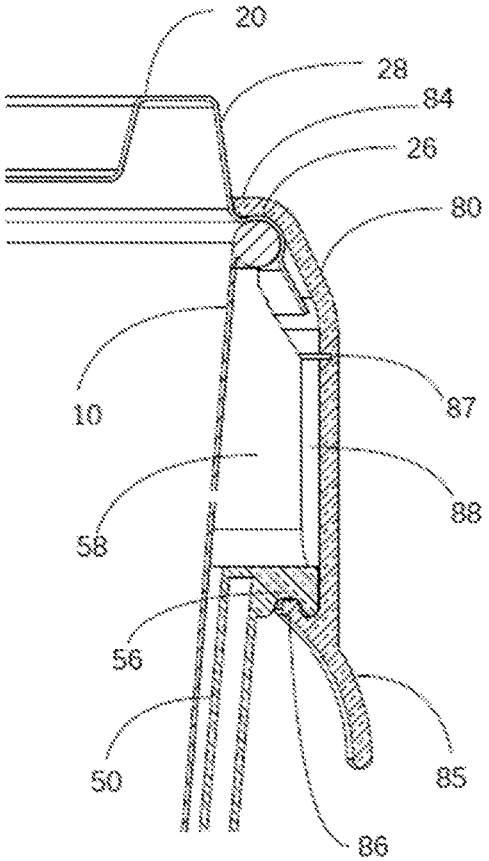
FIG. 6D shows a cross-section view of a portion of the cup holder of FIG. 6C.

In some examples, the skirt of the retainer may partially or fully cover the two or more gaps, e.g., in a manner such as illustrated in FIGS. 4F, 5A-5B, 10A-10C, 12A-12E, 13A-13E, 15A-15C, and 16A-16C. According to examples such as illustrated in FIGS. 5A and 5B, retainer 70 may further include skirt extensions 78 configured to substantially cover finger-sized gaps 48 when retainer 70 is properly aligned and secured to cup holder 40. By covering gaps 48, skirt extensions 78 help to reduce or minimize heat transfer between the contents of cup 10 and the outside environment. In other examples such as will be described with reference to FIGS. 6A-6D, 7A-7D, and 8A-8G, the latch(es) may partially or fully cover the two or more gaps when the retainer is coupled to the cup holder. In still other examples such as will be described with reference to FIGS. 9A-9B and 9C-9D, the latch(es) may partially or fully cover the two or more gaps when the lid is coupled to the cup holder.

According to examples such as illustrated in FIGS. 6A through 6D, a cup holder 50 includes a segmented upward-facing flange 59 with segments separated by finger-sized gaps 58 in side wall 52 to facilitate insertion of cup 10 in holder 50. Finger-sided gaps 58 are bounded on the bottom by a protruding latch-engagement feature 56 including a recess 57 configured to engage with a latch hook. Retainer 80 includes an inward facing circumferential lobe 84 with an inner diameter not less than the outer diameter of neck 28 of disposable lid 20, and not more than the diameter of the circular line of contact between bead 14 and upward-facing flange 39. Retainer 80 further includes a downward-extending skirt 81 below inward-facing lobe 84. The inner diameter of retainer skirt 81 is at least greater than the outer diameter of skirt 24 on lid 20 in order that retainer 80 may fit over skirt 24 without interference. Retainer 80 further includes latches 85, each including a latch hook 86. Latches 85 are attached to retainer 80 by hinges 87 such as, for example, living hinges, configured to allow latches to rotate between non-latching and latching positions. Latches 85 further include covers 88 configured to cover finger-sized gaps 58 when retainer 80 is installed on cup holder 50 and latches 85 are engaged with latch-engagement features 56.

In the examples illustrated in FIGS. 2A through 6D, the retainer may be completely separated from the cup holder in order to insert a cup into the holder. This presents an opportunity for the retainer to become lost, and it may be preferable to have a retainer that can be permanently or semi-permanently attached to the cup holder while still allowing it to open sufficiently to enable insertion of a cup and lid into the cup holder. In examples such as will be described with reference to FIGS. 7A-7D, 8A-8G, and 10A-10C, an assembly for holding a beverage cup may include a cup holder such as described elsewhere herein, and a retainer including a retaining ring, a latch, a first hinge movably coupling the latch to the retaining ring, and a second hinge movably coupling the retaining ring to the cup holder. The latch may engage the latch engagement feature to put the retainer in a first, closed position and may disengage the latch engagement feature to put the retainer in a second, open position.

In examples such as illustrated in FIGS. 7A through 7D, cup holder 370 includes a retainer attachment fixture 372 with a snap hook recess 374 that provides a secure but detachable fit for retainer snap attachment 384 on retainer 380 when retainer snap attachment 384 is pressed into fixture 372 (structural feature) as illustrated in FIG. 7C. In this configuration, retainer 380 is semi-permanently attached to cup holder 370 in the sense that it will not fall out of its own accord, but may be removed by forcibly detaching snap attachment 384 from fixture 372. Retainer 380 also includes latch 385 with latch hook 386, gap covers 381, and three hinges, for example, living hinges 382 that allow the various parts of retainer 380 to rotate relative to one another. In FIG. 7C, retainer 380 is in the open position allowing easy insertion of a cup and lid into holder 370. After cup and lid 20 have been inserted into holder 370, retainer 380 may be rotated about its hinges to a closed position, as illustrated in FIG. 7D, and latch 385 engages with latch-engagement feature 373 on cup holder 370 to secure retainer 380 in the closed position, thereby securing cup and lid in holder 370.

Figure 8A:
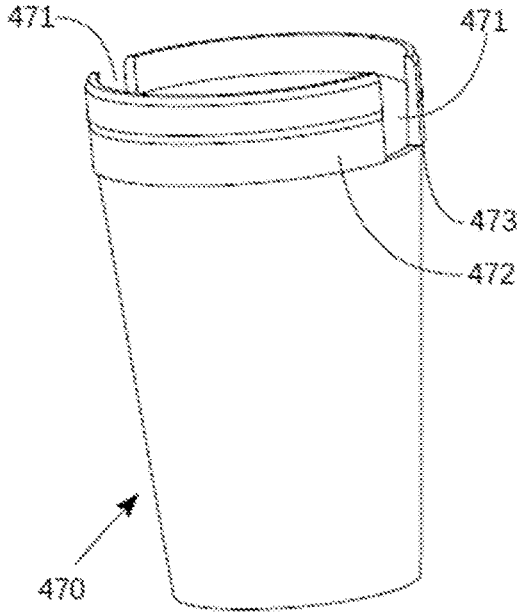
FIG. 8A shows a perspective view of a cup holder with a low-profile attachment for a retainer.
Figure 8B:
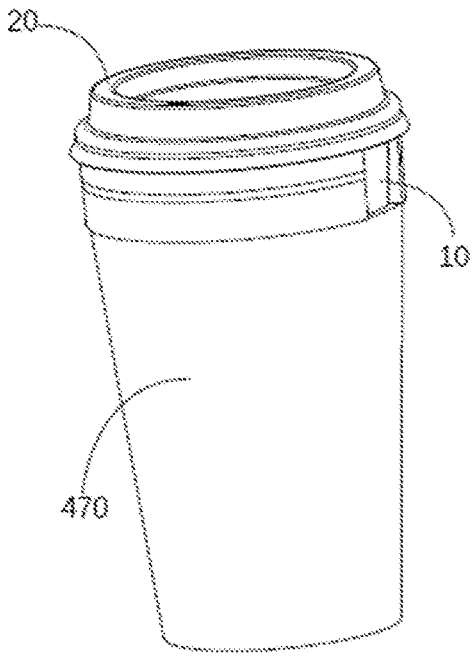
FIG. 8B shows a perspective view of the cup holder of FIG. 8A assembled with a cup and lid.
Figure 8C:
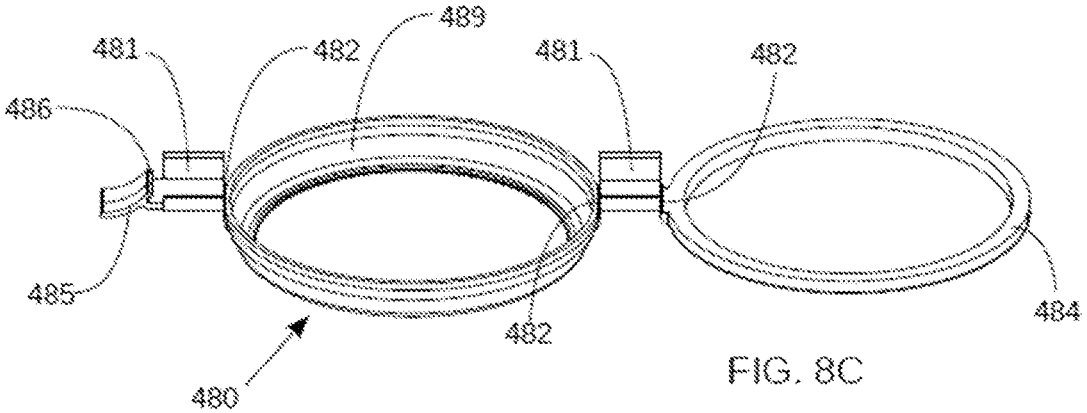
FIG. 8C shows a perspective view of a retainer configured to attach to the cup holder of FIG. 8A, as seen from above.
Figure 8D:
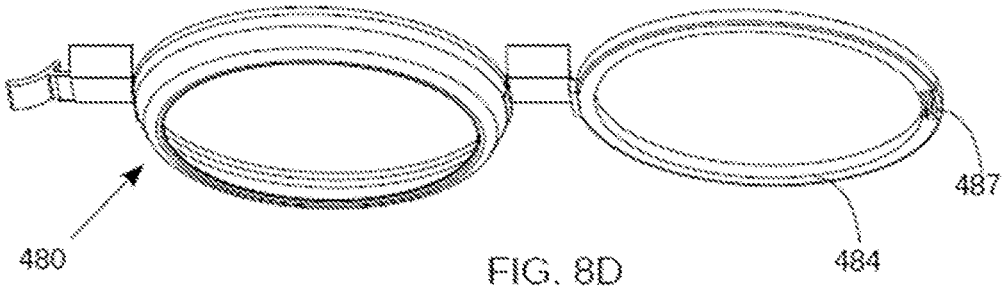
FIG. 8D shows a perspective view of the retainer of FIG. 8C, as seen from below.
Figure 8E:
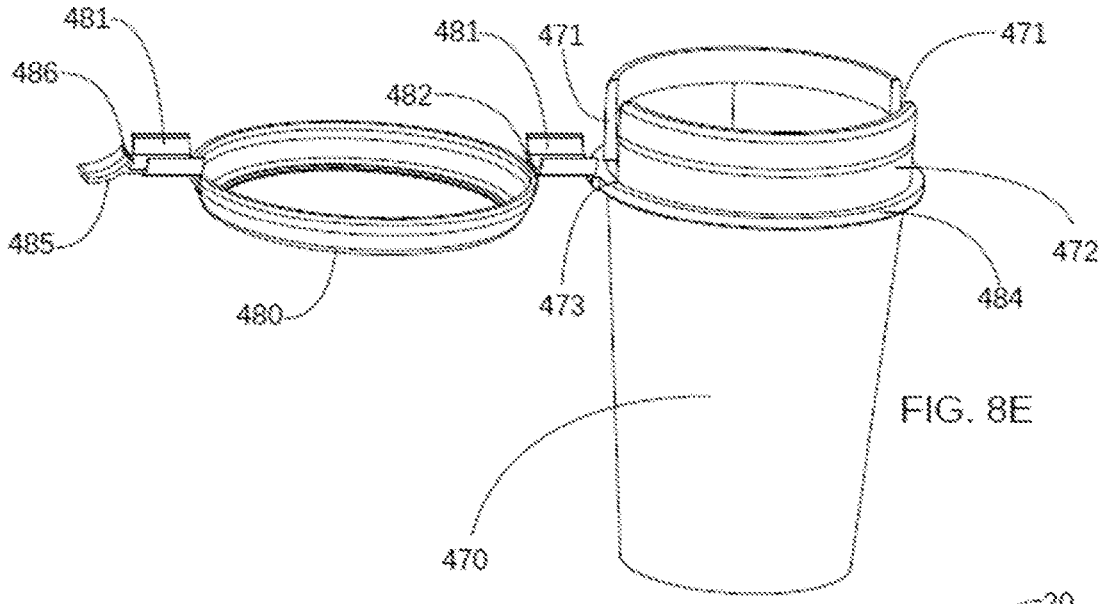
FIG. 8E shows a perspective view of the retainer of FIG. 8C assembled with the cup holder of FIG. 8A.
Figure 8F:
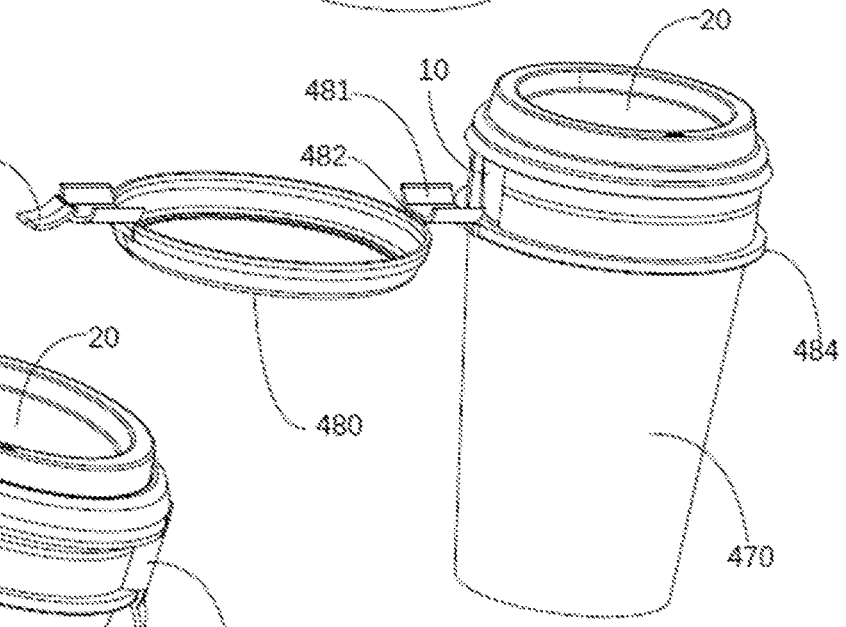
FIG. 8F shows a perspective view of the assembly of FIG. 8E further assembled with a cup and lid, with the retainer in the open position.
Figure 8G:
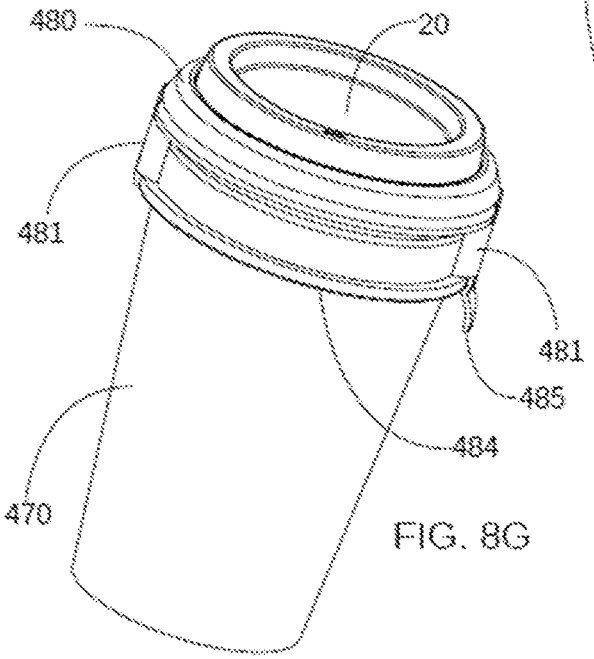
FIG. 8G shows a perspective view of the assembly of FIG. 8E further assembled with a cup and lid, with the retainer in the latched position.

Some users may prefer to use a cup holder without the retainer, may prefer a cup holder with cleaner lines, and/or may prefer not to have retainer attachment fixture 372 and/or latch-engagement feature 373 protruding from the side walls of the cup holder. In examples such as illustrated in FIGS. 8A through 8G, cup holder 470 includes a small step 473 in the diameter of side wall 472. Holder 470 may be used without a retainer as illustrated in FIG. 8B, where cup 10 with lid 20 have been inserted in holder 470. However, holder 470 may also be used with a retainer. Retainer 480 includes an attachment ring 484 configured to slide onto holder 470 from below, and sized to fit tightly around cup holder 470 just below step 473. Retainer 480 further includes retaining ring 489, latch 485 with latch hook 486, gap covers 481, and three hinges, for example, living hinges 482 that allow the various parts of retainer 480 to rotate relative to one another. Attachment ring 484 further includes a latch-engagement feature 487 on at least some portion of its downward face. In FIG. 8E, retainer 480 is semi permanently attached to holder 470, with retainer 480 in the open position, allowing easy insertion of a cup and lid into holder 470. After cup 10 and lid 20 have been inserted into holder 470 as illustrated in FIG. 8F, retainer 480 may be rotated about its hinges to a closed position, as illustrated in FIG. 8G, and latch 485 engages with latch-engagement feature 487 on the downward facing surface of attachment ring 484 to secure retainer 480 in the closed position, thereby securing cup 10 and lid 20 in holder 470.

In examples such as illustrated in FIGS. 9A through 9D, a beverage cup 10 is held within beverage cup holder 50 by means of a modified disposable beverage cup lid 90. A conventional disposable beverage cup 10 includes a radially-outwardly-extending peripheral bead 14, which provides a mating interface for a disposable lid 20 as illustrated, for example, in FIGS. 1B and 1C. Also illustrated in FIGS. 1B and 1C is a conventional disposable lid 20, which includes a radially-inwardly-opening circumferential groove 22 configured to mate through a snap fit with peripheral bead 14 of disposable cup 10, and a shoulder 26 that rests on the top of peripheral bead 14 when lid 20 is properly mated with disposable cup 10. Disposable lid 20 also includes a peripheral skirt 24 below circumferential groove 22, such that the skirt provides a guiding surface to assist in aligning the disposable lid for mating on bead 14 of disposable cup 10.

Figure 9A:
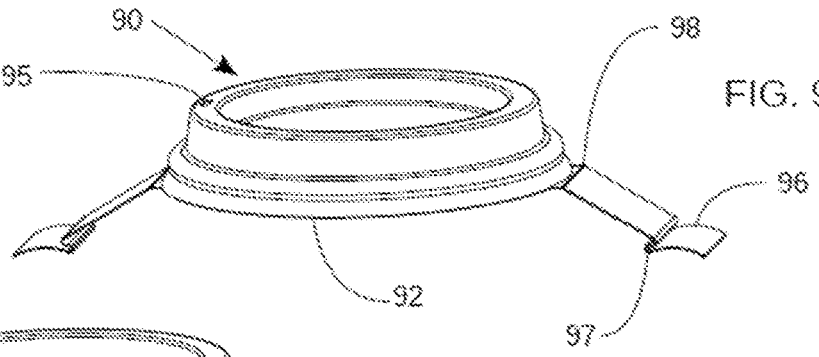
FIG. 9A shows a perspective view of a disposable lid with latches in the open position.
Figure 9B:
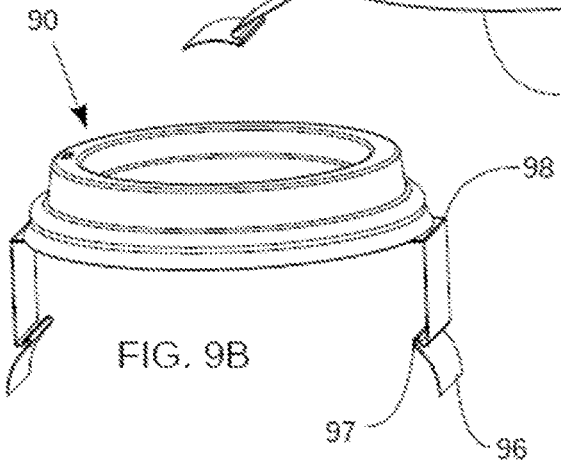
FIG. 9B shows a perspective view of a disposable lid with latches in the closed position.
Figure 9C:
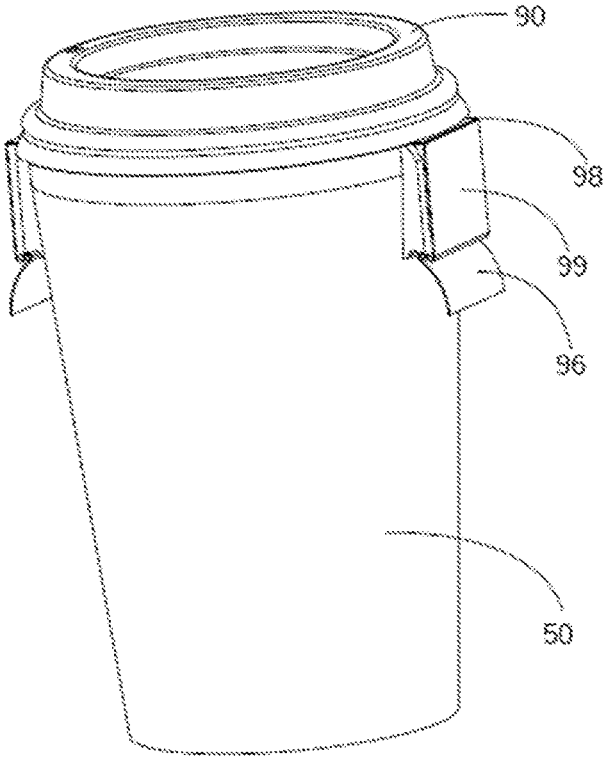
FIG. 9C shows a perspective view of the cup holder of FIG. 6A assembled with a cup and a lid including integral latches.
Figure 9D:
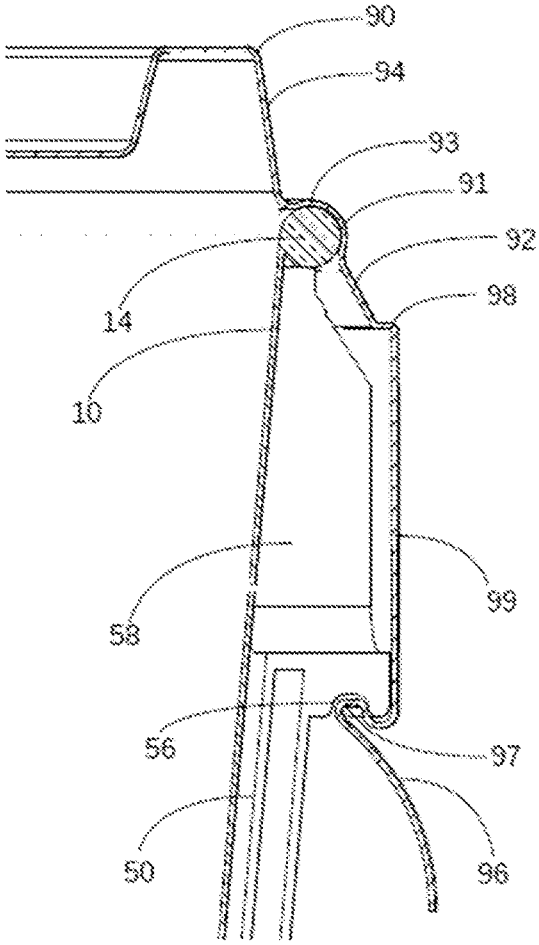
FIG. 9D shows a cross-section view of a portion of the cup holder, cup, and lid of FIG. 9C.

In examples such as illustrated in FIGS. 9A through 9D, a disposable beverage cup lid 90 includes a radially-inwardly-opening circumferential groove 91 configured to mate through a snap fit with peripheral bead 14 of disposable cup 10, a shoulder 93 that rests on the top of peripheral bead 14 when lid 90 is properly mated with disposable cup 10, a peripheral skirt 92 below circumferential groove 91, and a neck 94, on top of which there is a drinking port 95, all similar to conventional disposable lid 20. Disposable lid 90 further includes latches 96 connected to skirt 92 by hinges 98 that allow latches 96 to rotate between latched and unlatched positions, as illustrated in FIGS. 9A and 9B. Latches 96 further include latch hooks 97 and may include covers 99. FIGS. 9C and 9D illustrate the use of modified disposable lid 90 to secure cup 10 in holder 50. The user may attach lid 90 to cup 10 before inserting cup 10 in holder 50 or, alternatively, the user may insert cup 10 in holder 50 before attaching lid 90 to cup 10. In either case, once cup 10, lid 90 and holder 50 are assembled, user may rotate latches 96 to engage latch hooks 97 with latch-engagement features 56. When latch hooks are properly engaged covers 99, if present, may substantially cover finger-sized gaps 58 to reduce heat flow.

Figure 10A:
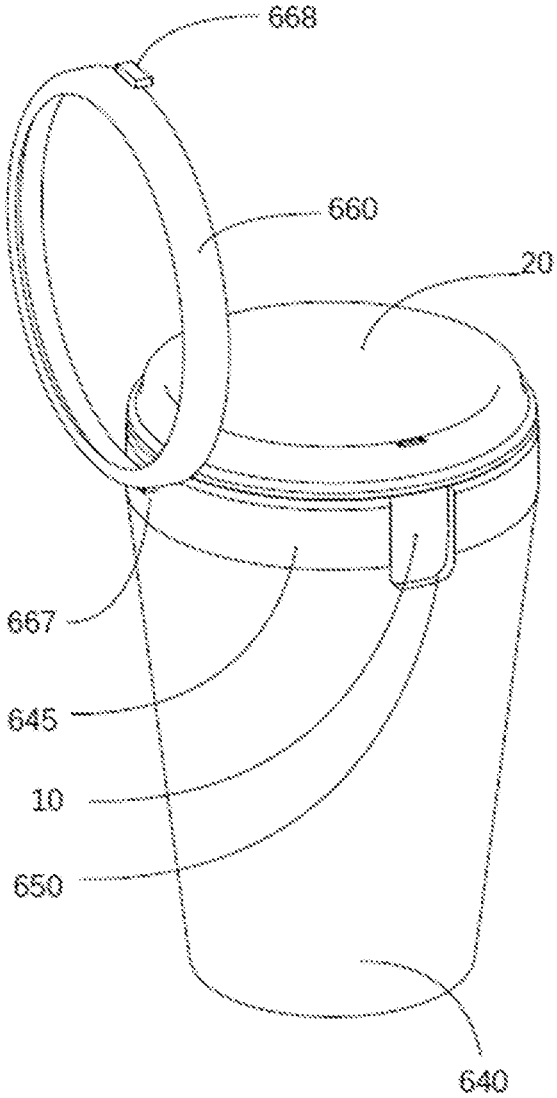
FIG. 10A shows a perspective view of an insulating cup holder containing a disposable cup and lid with a hinged retainer in the open position.
Figure 10B:
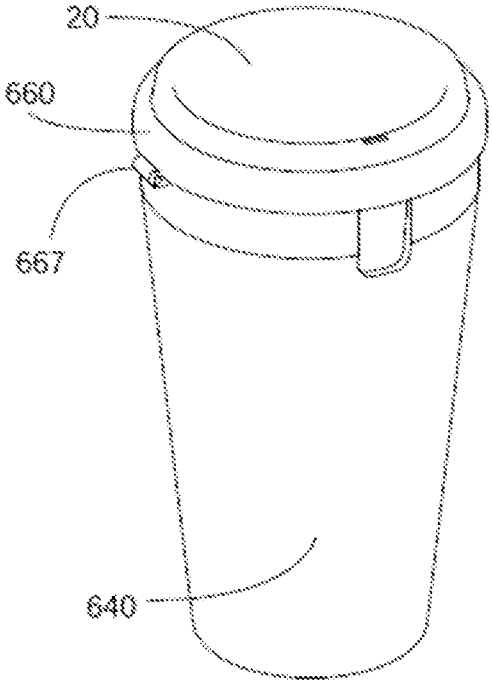
FIG. 10B shows a perspective view of an insulating cup holder containing a disposable cup and lid with a hinged retainer in the locked position, seen from the hinge side.
Figure 10C:
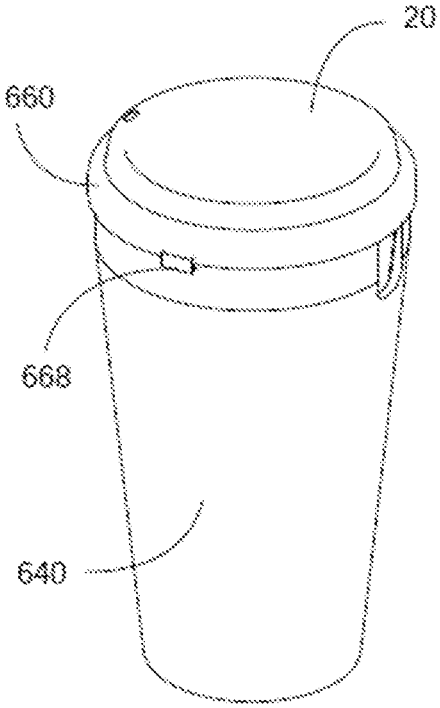
FIG. 10C shows a perspective view of an insulating cup holder containing a disposable cup and lid with a hinged retainer in the locked position, seen from the latch side.

Other examples may include other suitable means for securing a beverage cup within the cup holder without a separable retainer. For example, in configurations such as illustrated in FIGS. 10A, 10B, and 10C, retainer 660 is attached to insulating cup holder 640 by means of hinge 667 mounted on cup-holder wall 645, which allows retainer 660 to be rotated up and away from the top of cup holder 640 to allow insertion of a beverage cup 10 (visible through finger-sized slot 650) with an attached lid 20 into cup holder 640. After the beverage cup is inserted, retainer 660 may be rotated on hinge 667 to a position where it will hold cup and lid 20 in cup holder 640. Retainer 660 may be secured in this position by means of latch 668. Cup holder 640 optionally may include two or more finger sized gaps 650 in a manner such as described elsewhere herein.

According to examples as illustrated in FIGS. 11A through 11E, cup holder 34 is seen to contain a disposable beverage cup 10 and a conventional disposable lid 20, which are retained in cup holder 10 with a releasable cup retaining means 160. Cup 10 may be made of plastic, paper, or paper coated with materials such as plastic or wax, depending on the nature of the beverage for which it is intended. The cup walls 16 take the shape of an inverted truncated cone, with generally flat and parallel top and bottom. The bottom 12 is closed with a generally flat or slightly domed surface, which may be offset from the bottom edge of the side walls. At the upper edge, the cup includes a radially-outwardly-extending peripheral bead 14, which provides structural rigidity to the circular upper opening of the cup, and provides a mating interface for a disposable lid. As illustrated in FIGS. 11B through 11E, conventional disposable lid 20 includes a radially-inwardly-opening circumferential groove 22 configured to mate through a snap fit with peripheral bead 14 of disposable cup 10, and a shoulder 26 that rests on the top of peripheral bead 14 when lid 20 is properly mated with disposable cup 10. Disposable lid 20 also includes a peripheral skirt 24 below peripheral groove 22, such that the skirt provides a guiding surface to assist in aligning the disposable lid for mating on bead 14 of disposable cup 10. Disposable lid 20 also includes a neck 28 leading to an elevated section containing a drinking port 29.

Cup holder 34 includes a wall 32 substantially in the form of a truncated inverted cone open at the top and closed at the bottom by a generally flat bottom surface 33. Near its top, wall 32 includes a short substantially cylindrical section 31 and ends in an upward-facing circular flange 39 configured to support cup 10 at the underside of peripheral bead 14. The inner diameter of upward-facing flange 39 is preferably greater than or equal to the diameter of side wall 16 of disposable beverage cup 10 at the level of the bottom of bead 14. Further, the outer diameter of upward-facing flange 39 is preferably less than the inner diameter of skirt 24 on disposable lid 20. These dimensional constraints ensure that bead 14 is able to rest without interference on upward-facing flange 39 when beverage cup 10 with mating lid 20 are together inserted into cup holder 34. Alternatively, beverage cup 10 without lid 20 may be inserted into cup holder 34, with lid 20 being attached to cup 10 after insertion into cup holder 34.

According to examples as illustrated in FIGS. 11A through 11E, disposable beverage cup 10 in combination with lid 20 may be retained within cup holder 34 by means of a releasable retainer. In the embodiment illustrated in FIGS. 11A through 11E, the releasable retainer is in the form of a retaining ring 160. Retaining ring 160 includes an inward facing circumferential lobe 164 with an inner diameter not less than the outer diameter of neck 28 of disposable lid 20, and not more than the diameter of the circular line of contact between bead 14 and upward-facing flange 39. Retaining ring 160 further includes a skirt 161 below inward-facing lobe 164. The inner diameter of retaining ring skirt 161 is at least greater than the outer diameter of skirt 24 on lid 20 in order that retaining ring 160 may fit over skirt 24 without interference. Retaining ring 160 further includes a set of retaining ring threads 162 on the inner surface of skirt 161, and cup holder 34 further includes a set of cup holder threads 38 on cylindrical section 31 of wall 32, where retaining ring threads 162 are configured to mate with cup holder threads 38 allowing retaining ring 160 to be detachably secured to cup holder 34. When retaining ring 160 is secured to cup holder 34, lobe 164 will apply a downward force on shoulder 26 of disposable lid 20, which force will apply pressure though lid 20 to bead 14, thereby ensuring that lid 20 remains secured on cup 10 and that the lid and cup together remain securely held in cup holder 34.

Figure 11A:
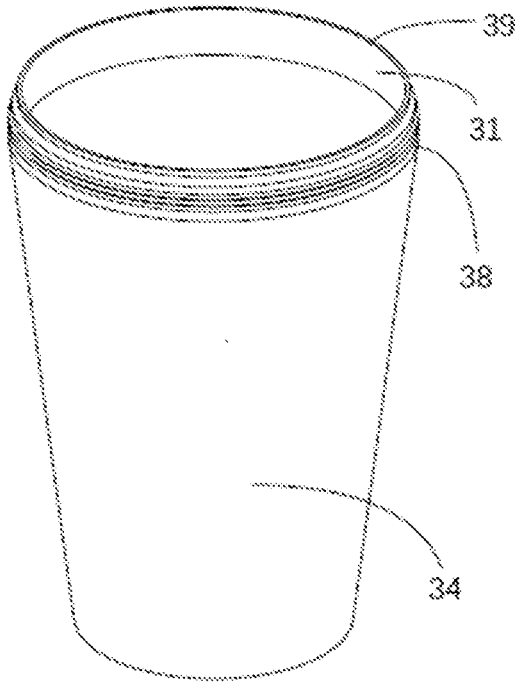
FIG. 11A shows a perspective view of a cup holder with a threaded connection for attaching a cup retaining means.
Figure 11B:
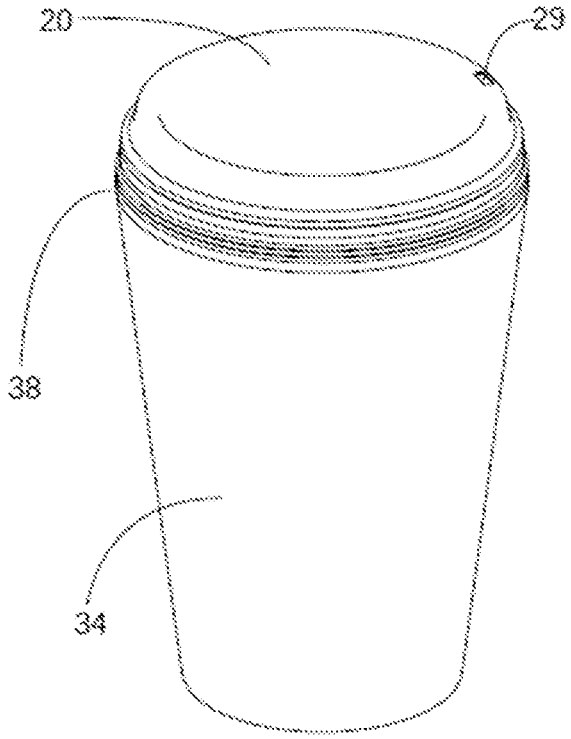
FIG. 11B shows a perspective view of the cup holder of FIG. 11A containing a disposable cup and lid.
Figure 11C:
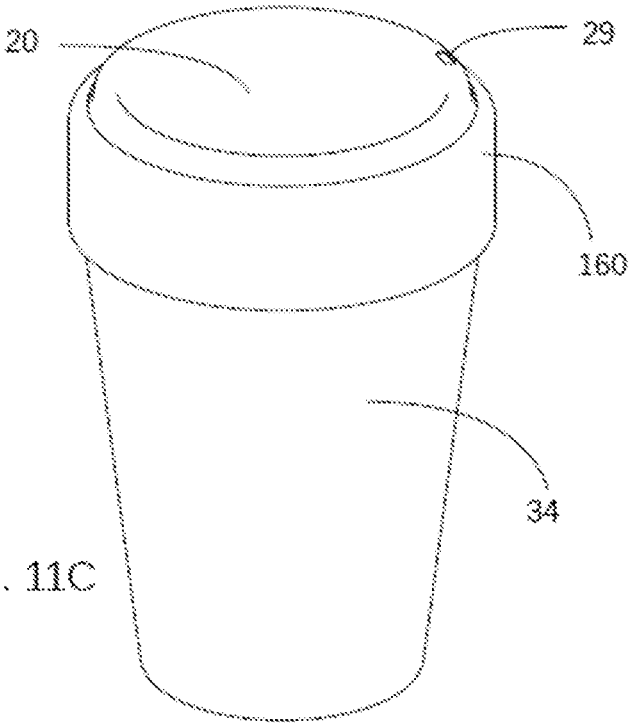
FIG. 11C shows a perspective view of the cup holder of FIG. 11A containing a disposable cup and lid secured in place by a detachable retaining ring.

According to examples as illustrated in FIGS. 11A through 11E, upward-facing flange 39 constitutes an unbroken ring configured to interface with peripheral bead 14 of disposable beverage cup 10. When the flange is unbroken, as illustrated in FIG. 11A, it may be difficult to insert a beverage cup containing a liquid beverage into cup holder 34 without risk of spilling some liquid. This is because a filled beverage cup is most easily and securely held by its side walls, while an unbroken upward-facing flange would force the user to hold a beverage cup by its peripheral bead for insertion into cup holder 34. Further, if a filled beverage cup is covered with a disposable lid the bead is no longer accessible and insertion into cup holder 34 would require that the cup and lid combination be held by the skirt of the lid, with the potential that the lid could detach from the bead and spill the contents of the cup. This is clearly illustrated in FIG. 11B, where cup 10 with lid 20 have been inserted in holder 34, but no part of cup 10 is visible, indicating that the user would not be able to maintain contact with cup 10 while inserting the cup and lid combination into cup holder 34.

Figure 12A:
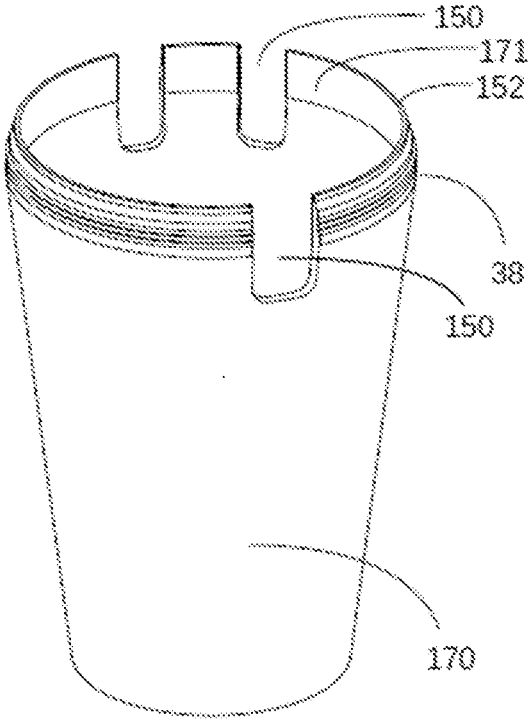
FIG. 12A shows a perspective view of a cup holder with a threaded connection for attaching a cup retaining means and three finger-sized gaps in the wall of the cup holder.
Figure 12B:
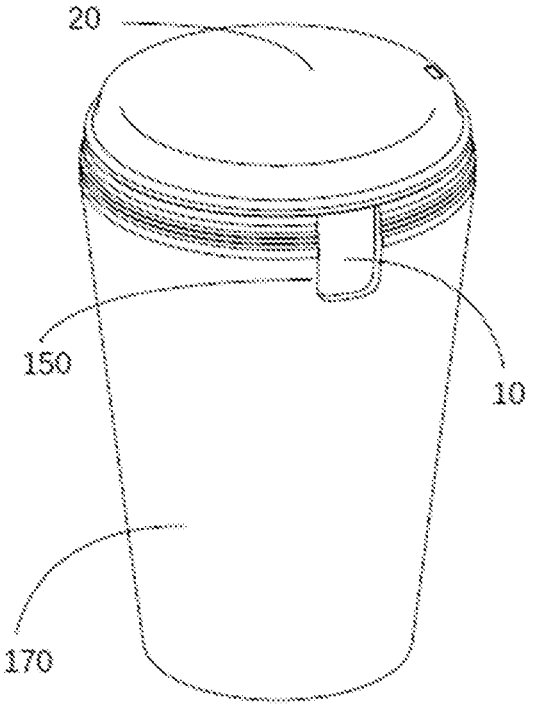
FIG. 12B shows a perspective view of the cup holder of FIG. 12A containing a disposable cup and lid.
Figure 12C:
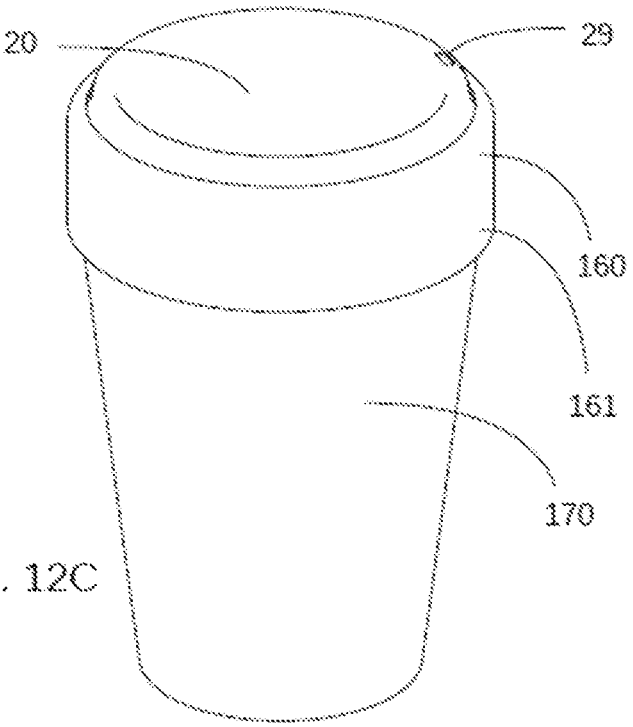
FIG. 12C shows a perspective view of the cup holder of FIG. 12A containing a disposable cup and lid secured in place by a detachable retaining ring.
Figure 12D:
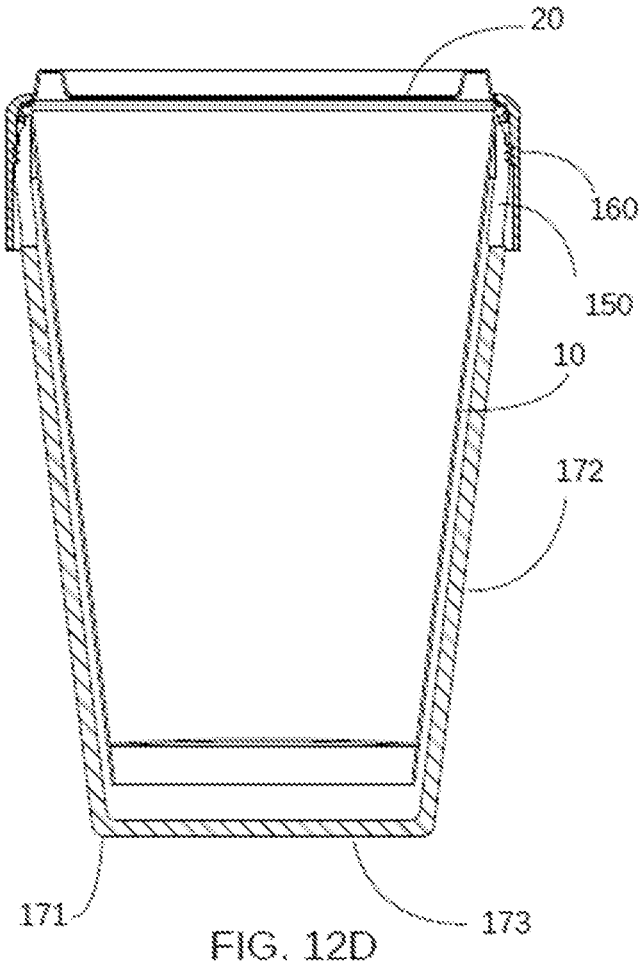
FIG. 12D shows a cross-section view of the cup holder, disposable cup, lid, and retaining ring of FIG. 12C.
Figure 12E:
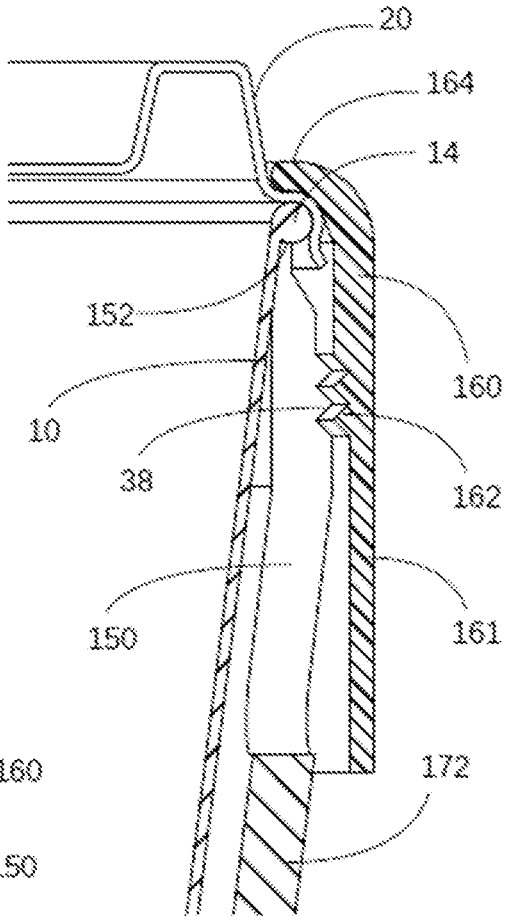
FIG. 12E shows a closeup of a portion of the cup holder, disposable cup, lid, and retaining ring of FIG. 12D.

According to examples as illustrated in FIGS. 12A through 12E, a cup holder 170 includes a wall 172 substantially in the form of a truncated inverted cone open at the top and closed at the bottom by a generally flat bottom surface 173. Near its top, wall 172 includes a short substantially cylindrical section 171 and ends in a segmented upward-facing circular flange 152 configured to support cup 10 at the underside of peripheral bead 14. The inner diameter of upward-facing flange 152 is preferably greater than or equal to the diameter of side wall 16 of disposable beverage cup 10 at the level of the bottom of bead 14. Further, the outer diameter of upward-facing flange 152 is preferably less than the inner diameter of skirt 24 on disposable lid 20. Upward-facing flange 152 is broken into segments separated by two or more gaps 150 extending downward into the upper part of wall 172 of cup holder 170. Gaps 150 are sized to allow a disposable cup 10 to be grasped between two or more fingers (where the term "fingers" is understood to include the thumb) as it is being inserted into cup holder 170, and to allow the grip on cup 10 to be maintained until cup 10 is fully inserted into cup holder 170 such that bead 14 is resting stably on segmented flange 152. Gaps 150 may be of a uniform size, or one may be larger than the one or more others to fit the thumb, which is typically larger than the other fingers. Further, gaps 150 are sized to allow finger contact with the walls of disposable beverage cup 10 until the bead rests on segmented flange 152 even when disposable lid 20 is attached to disposable beverage cup 10. This is illustrated in FIG. 12B where cup 10 with lid 20 have been inserted in holder 170 and the side wall of cup 10 is visible through gap 150, indicating that the user would be able to maintain contact with the cup wall throughout the insertion process. Cup holder 170 further includes threads on the cylindrical section 171 of wall 172 configured to mate with threads 162 on retaining ring 160. After cup 10 with lid 20 is fully inserted into cup holder 170, retaining ring 160 may be attached, as illustrated in FIGS. 12C through 12E, to prevent a filled beverage cup 10 from being easily dislodged from cup holder 170.

According to examples as illustrated in FIGS. 13A through 13E, inner shell 141 includes an inner wall 142 in the form of a truncated inverted cone open at the top, and closed at the bottom by an inner bottom surface 143. Similarly, outer shell 144 includes an outer wall 145 in the form of a truncated inverted cone open at the top, and closed at the bottom by an outer bottom surface 146. At its upper end, inner wall 142 includes a short cylindrical section 255. At its upper end, outer wall 145 includes a short cylindrical section 256 and threads 148 configured to mate with threads 162 of retaining ring 160. The uppermost edges of inner wall 142 and outer wall 145 are joined together forming a segmented upward-facing circular flange 252 along their top-most surfaces, where the segments of flange 252 are separate by gaps 250 sized to allow finger contact with the walls of disposable beverage cup 10 until the bead rests on segmented flange 152 even when disposable lid 20 is attached to disposable beverage cup 10. The inner diameter of upward-facing flange 252 is preferably greater than the diameter of side wall 16 of disposable beverage cup 10 at the level of the bottom of bead 14. Further, the outer diameter of upward-facing flange 252 is preferably less than the inner diameter of skirt 24 on disposable lid 20. The joint between the upper edges of inner wall 142 and outer wall 145 is preferably sealed to form a closed insulating space 147 between inner shell 141 and outer shell 144. Further, the perimeters of gaps 250 may be closed by a wall segment 258 connecting inner wall 142 and outer wall 145 to maintain a seal around insulating space 147. Insulating space 147 may preferably be evacuated to minimize heat transport between the inner and outer walls. Alternatively, insulating space 147 may be filled with an insulating material or may simply be filled with air. Other than along the joint at their upper edges, and along the perimeters of gaps 250, inner shell 141 and outer shell 144 are preferably not in physical contact with one another in order to minimize heat transfer between them.

Figure 13A:
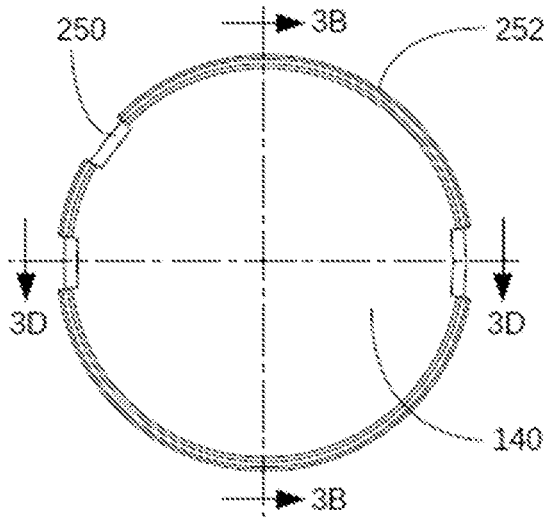
FIG. 13A shows a top view of an insulating cup holder with finger-sized gaps in the wall of the insulating cup holder.
Figure 13C:
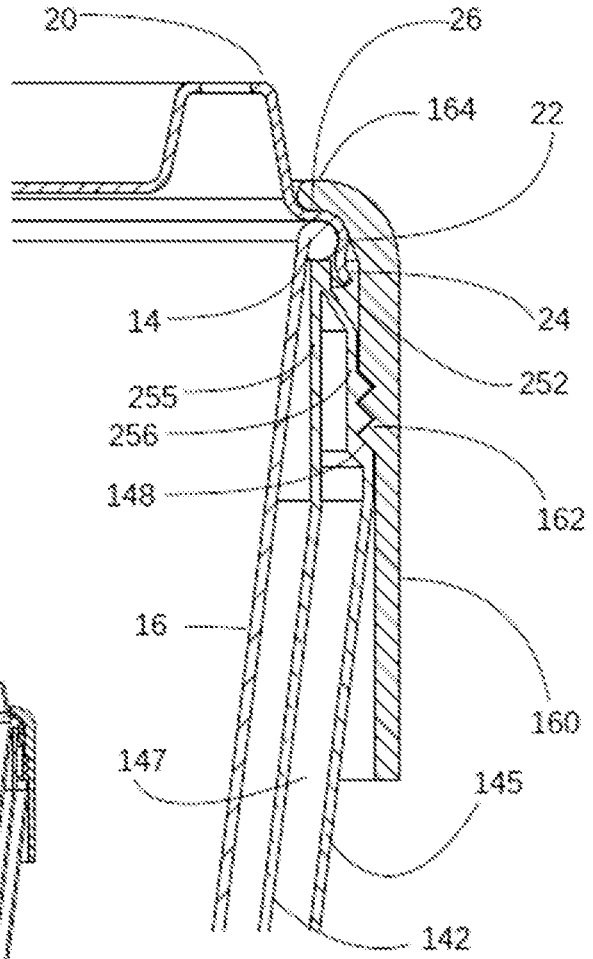
FIG. 13C shows a closeup of a portion of the cup holder of FIG. 13B.
Figure 13B:
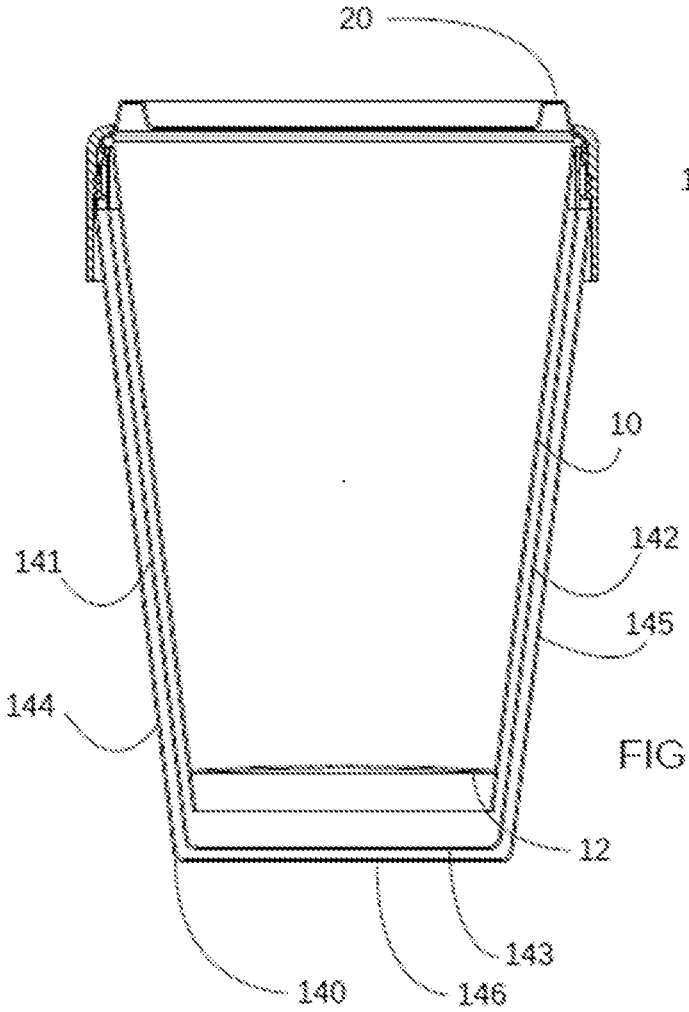
FIG. 13B shows a cross-section view of a disposable cup and lid detachably secured by a threaded retaining ring in the insulating cup holder of FIG. 13A, with the cross section along a plane not intersecting the finger-sized gaps.
Figure 13D:
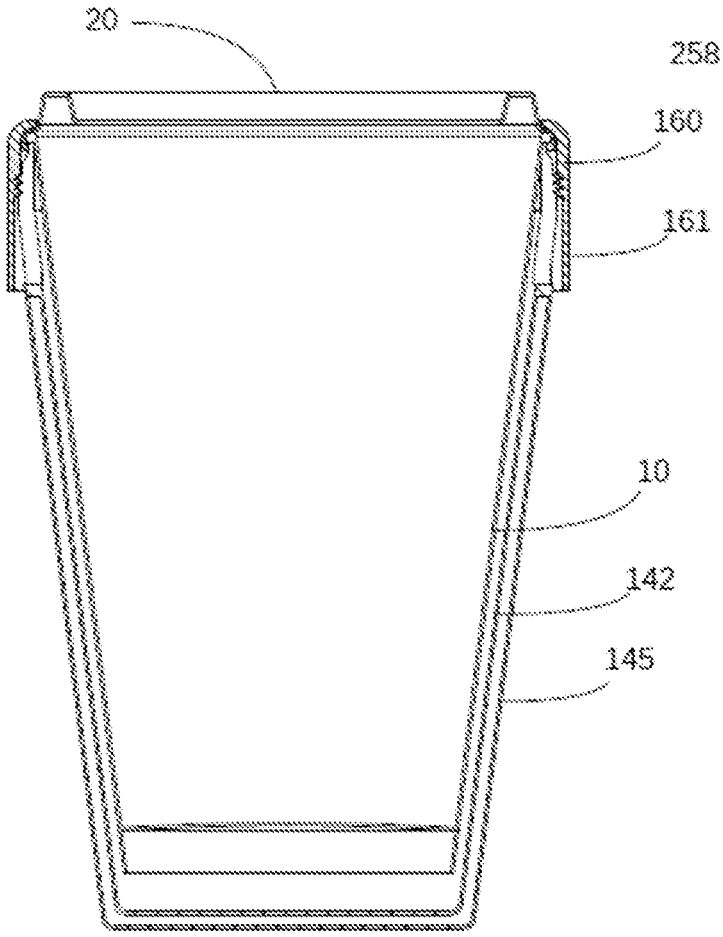
FIG. 13D shows a cross-section view of a disposable cup and lid detachably secured by a threaded retaining ring in the insulating cup holder of FIG. 13A, with the cross section along a plane intersecting the finger-sized gaps.
Figure 13E:
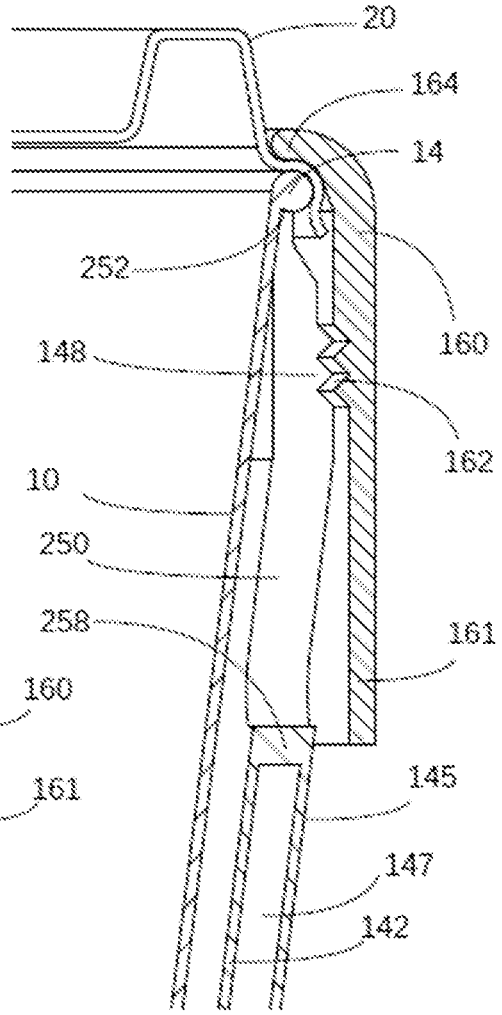
FIG. 13E shows a closeup of a portion of the cup holder of FIG. 13D.

According to examples as illustrated in cross section in FIGS. 13D and 13E, retaining ring 160 includes a retaining-ring skirt 161 extending downward from inward facing lobe 164 a sufficient distance to substantially cover finger-sized gaps 250 in order to minimize heat transfer to and from disposable beverage cup 10.

Figure 14A:
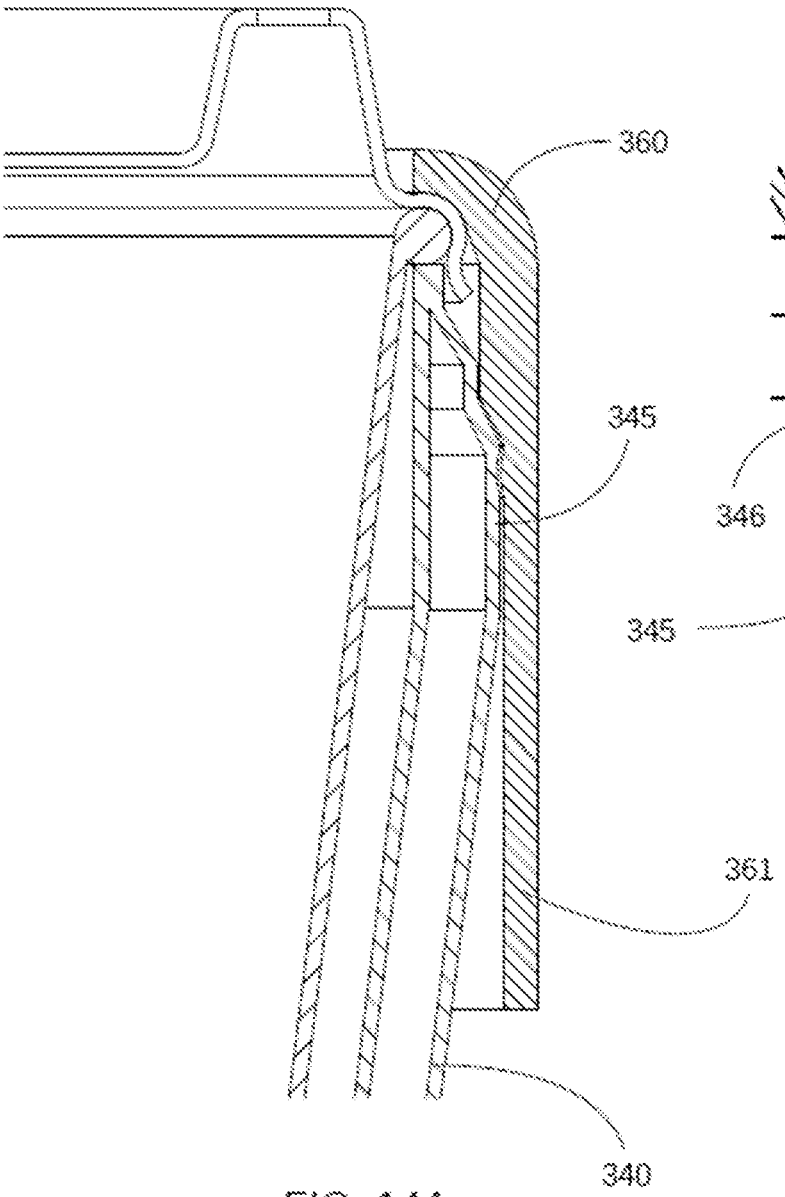
FIG. 14A shows a cross-section view of the upper portion of an insulating cup holder containing a disposable cup and lid secured in place by a detachable retaining ring using a snap fit.
Figure 14B:
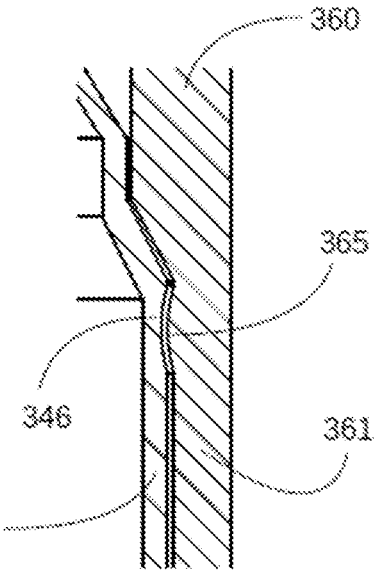
FIG. 14B shows a closeup view of the snap fit in FIG. 14A.

According to examples as illustrated in FIGS. 11A-11E, 12A-12E, and 13A-13E, retaining ring 160 is detachably secured to insulating cup holder 140 by means of a threaded connection. According to examples as illustrated in FIG. 14A and in closeup in FIG. 14B, retaining ring 360 is detachably secured to insulating cup holder 340 by means of a snap fit. In this embodiment, outer side wall 345 of insulating cup holder 340 includes an outward-facing circumferential groove 346. Retaining ring 360 included an inward-facing circumferential protrusion as part of skirt 361 sized to mate in a snap fit with circumferential groove 346 when retaining ring 360 is pressed down onto insulating cup holder 340.

Figure 15B:
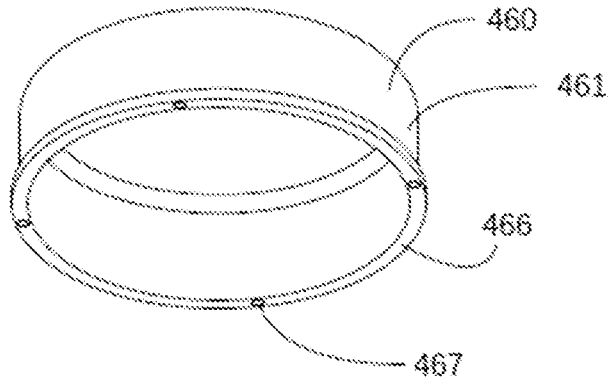
FIG. 15B shows a perspective view of a retaining ring with a magnetic connection.
Figure 15C:
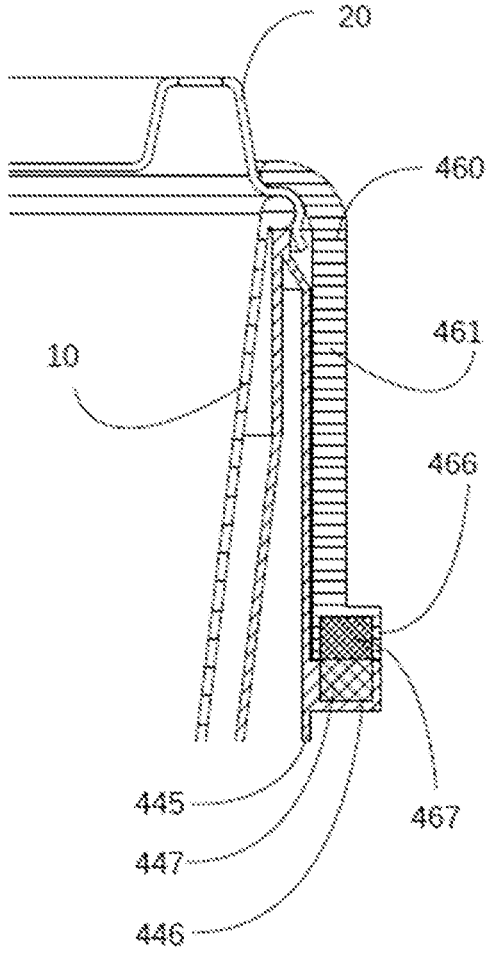
FIG. 15C shows a cross-section view of the upper portion of an insulating cup holder containing a disposable cup and lid secured in place by a detachable retaining ring using a magnetic connection.
Figure 15A:
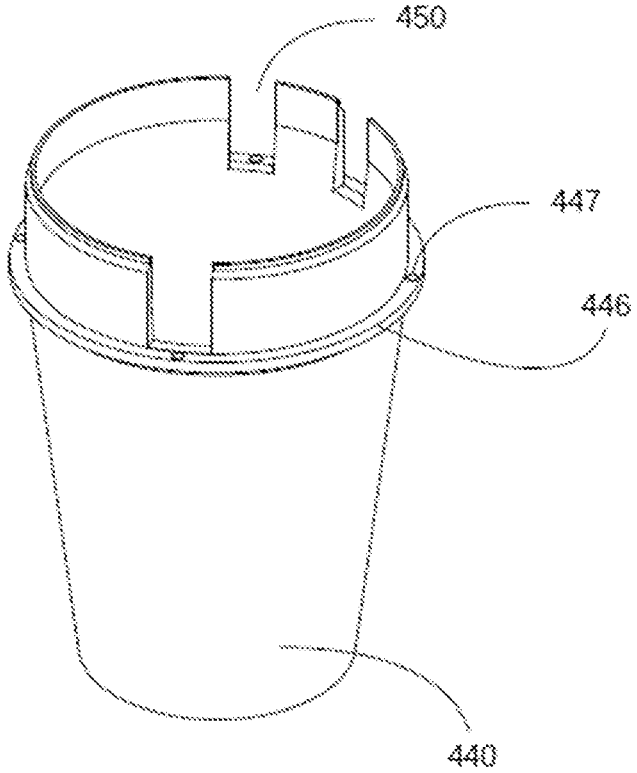
FIG. 15A shows a perspective view of an insulating cup holder with a magnetic connection for a retaining ring.

According to examples as illustrated in FIGS. 15A, 15B, and 15C, retaining ring 460 is detachably secured to insulating cup holder 440 by means of magnets. In FIG. 15A, insulating cup holder 440 includes a circumferential flange 446 extending radially outward from outer wall 445 just below finger-sized gaps 450. As shown in FIG. 15A, flange 446 holds four magnets distributed around the circumference. In FIG. 15B, retaining ring 460 includes a circumferential flange 466 extending radially outward from the bottom of retaining ring skirt 461. Flange 466 also holds four magnets distributed around the circumference in the same pattern as flange 446 such that when retaining ring 460 is mounted on cup holder 440 the magnets can attract one another and apply a holding force, thereby securing retaining ring 460 in place. It should be appreciated that, while four magnet pairs are shown for illustration purposes in FIGS. 15A and 15B, the actual number used to secure retaining ring 460 to cup holder 440 may be more or less than four as required to provide the necessary securing force. It should also be appreciated that magnet pairs may be arranged with alternating polarity so that the user may easily release the holding force on retaining ring 460 by twisting the ring so that the magnets in the retaining ring are no longer aligned with magnets of the correct polarity in the cup holder and are instead aligned with magnets of opposite polarity, thereby generating a force tending to push the retaining ring away from the cup holder. The complete assembly, including beverage cup 10 and lid 20, is shown in cross section in FIG. 15C.

Figure 16B:
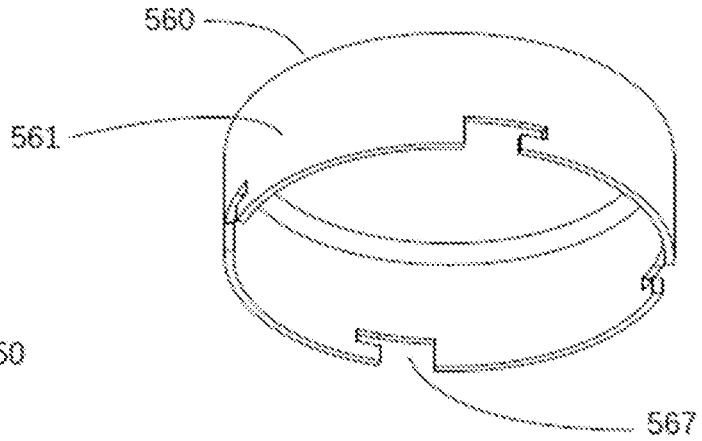
FIG. 16B shows a perspective view of a retaining ring with a twist lock connection.
Figure 16A:
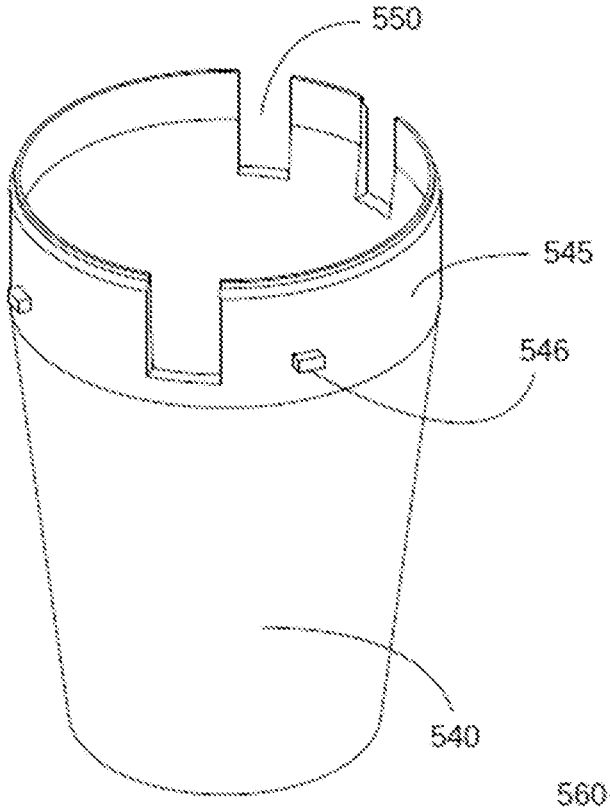
FIG. 16A shows a perspective view of an insulating cup holder configured to mate with a retaining ring using a twist lock connection.
Figure 16C:
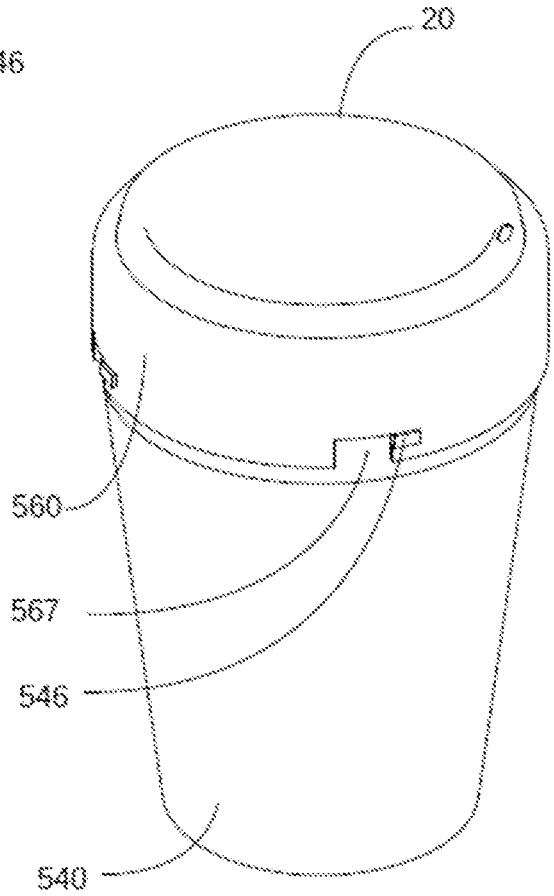
FIG. 16C shows a perspective view of an insulating cup holder containing a disposable cup and lid secured in place by a detachable retaining ring using a twist lock connection.

According to examples as illustrated in FIGS. 16A, 16B, and 16C, retaining ring 560 is detachably secured to insulating cup holder 540 by means of a rotary clamping action. In FIG. 16A, insulating cup holder 540 includes a set of protrusions 546 extending radially outward from outer wall 545 just above the bottom of finger-sized gaps 550. In FIG. 16B, retaining ring 560 includes a matching set of slots 567 in the bottom of retaining ring skirt 561. Retaining ring 560 may be secured to cup holder 540 by sliding slots 567 over protrusions 546 and twisting retaining ring 560 to lock slots 567 over protrusions 546 as illustrated in FIG. 16C.

According to examples as illustrated in FIGS. 11A-11E, 12A-12E, 13A-13E, 14A-14B, 15A-15C, and 16A-16C, the retaining ring may be detached from the insulating cup holder to allow for insertion and removal of beverage cups. In these embodiments, it is possible for the retaining ring to become separated from the insulating cup holder and possibly lost. In other embodiments, means are provided for securing a beverage cup within the cup holder without a separable retaining ring.

Figure 17A:
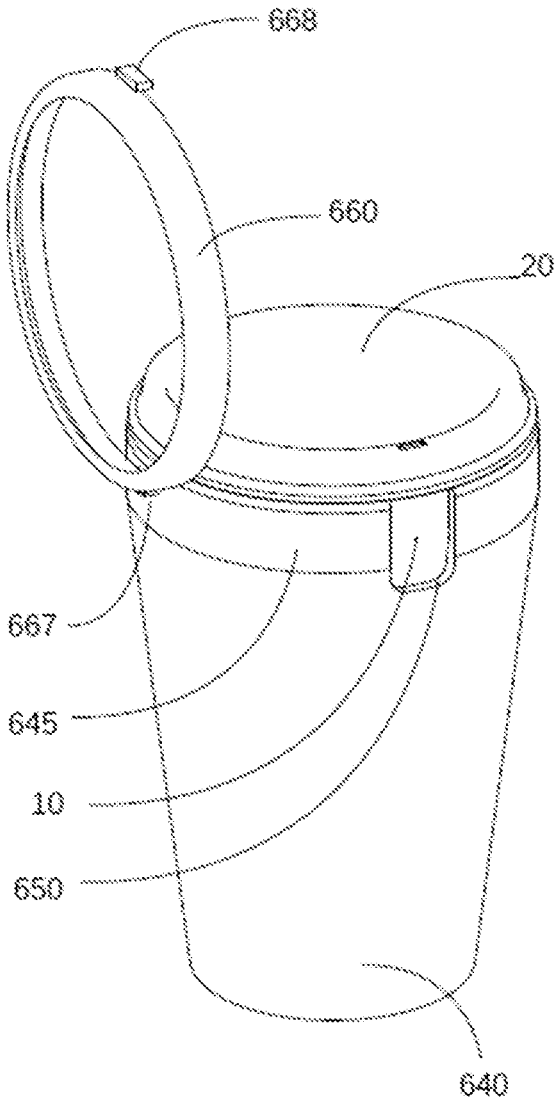
FIG. 17A shows a perspective view of an insulating cup holder containing a disposable cup and lid with a hinged retaining ring in the open position.
Figure 17B:
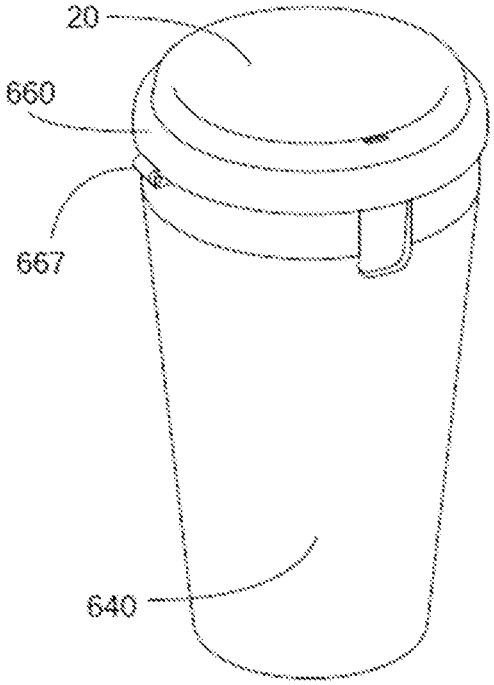
FIG. 17B shows a perspective view of an insulating cup holder containing a disposable cup and lid with a hinged retaining ring in the locked position, seen from the hinge side.
Figure 17C:
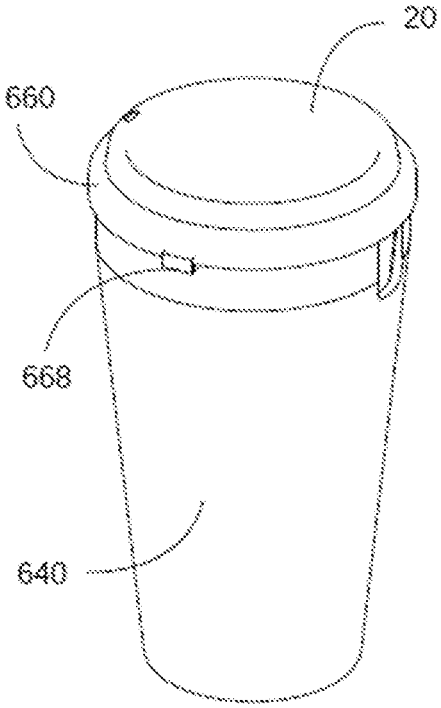
FIG. 17C shows a perspective view of an insulating cup holder containing a disposable cup and lid with a hinged retaining ring in the locked position, seen from the latch side.

According to examples as illustrated in FIGS. 17A, 17B, and 17C, retaining ring 660 is attached to insulating cup holder 640 by means of hinge 667, which allows retaining ring 660 to be rotated up and away from the top of cup holder 640 to allow insertion of a beverage cup 10 (visible through finger-sized slot 650) with an attached lid 20 into cup holder 640. After the beverage cup is inserted, retaining ring 660 may be rotated on hinge 667 to a position where it will hold cup and lid 20 in cup holder. Retaining ring 660 may be secured in this position by means of latch 668.

Figure 18A:
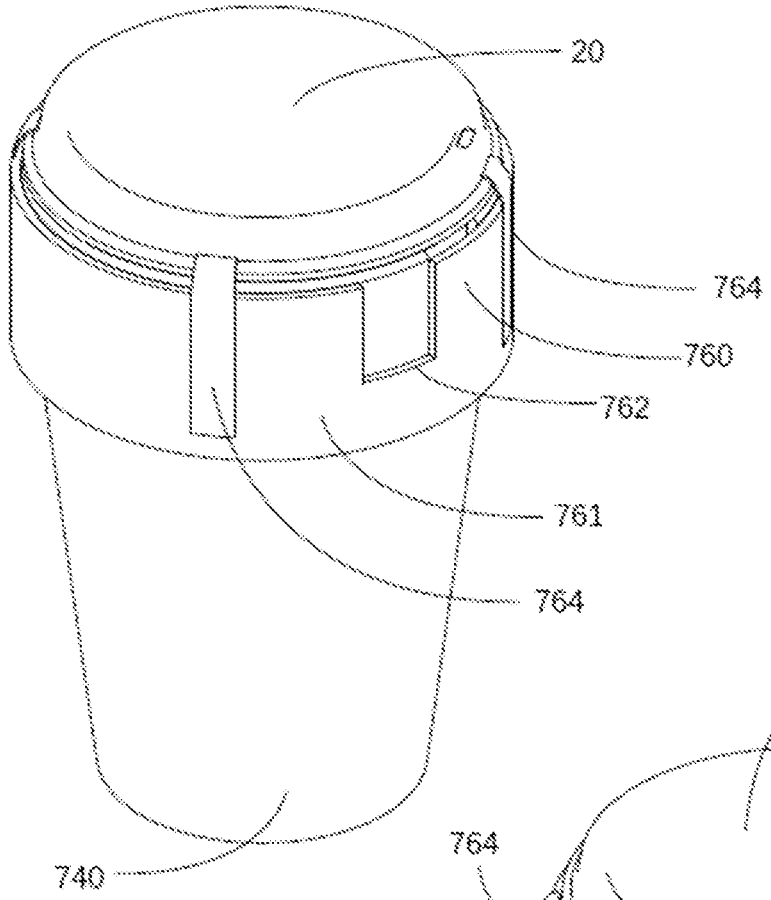
FIG. 18A shows a perspective view of an insulating cup holder containing a disposable cup and lid with a retractable clamp mechanism in the locked position.
Figure 18B:
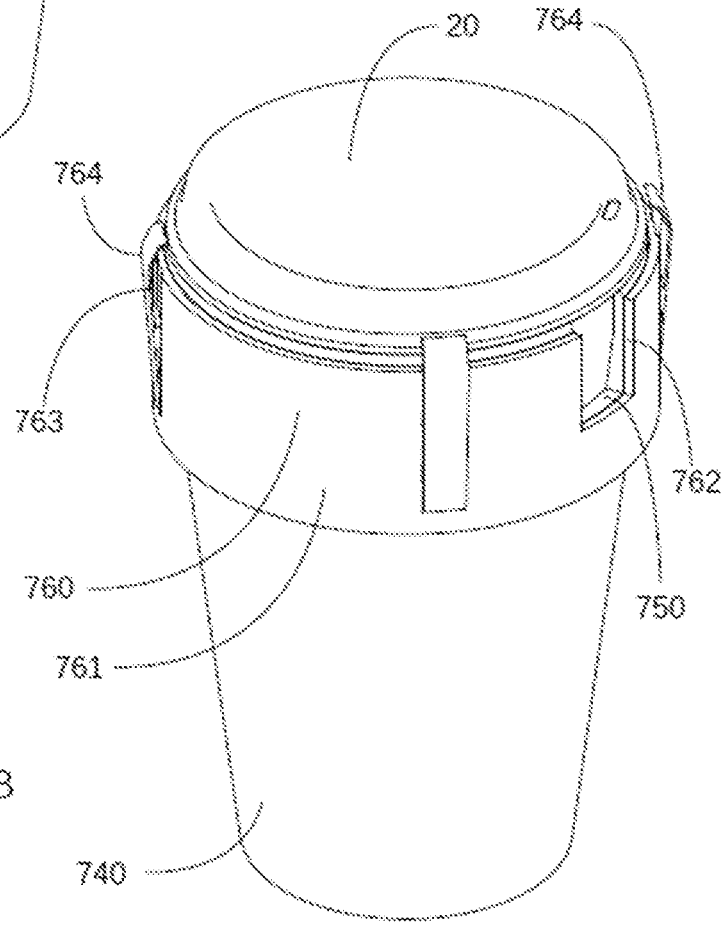
FIG. 18B shows a perspective view of an insulating cup holder containing a disposable cup and lid with a retractable clamp mechanism in the open position.
Figure 18D:
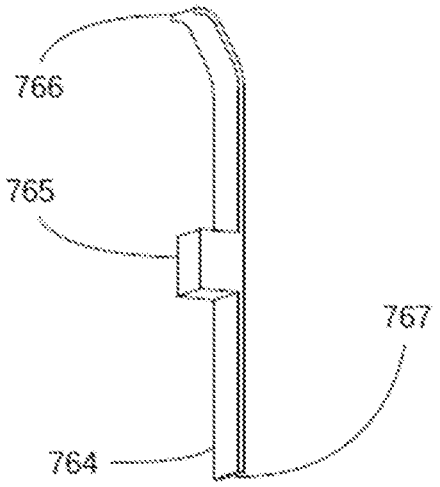
FIG. 18D shows a perspective view of a retractable clamp for an insulating cup holder.
Figure 18E:
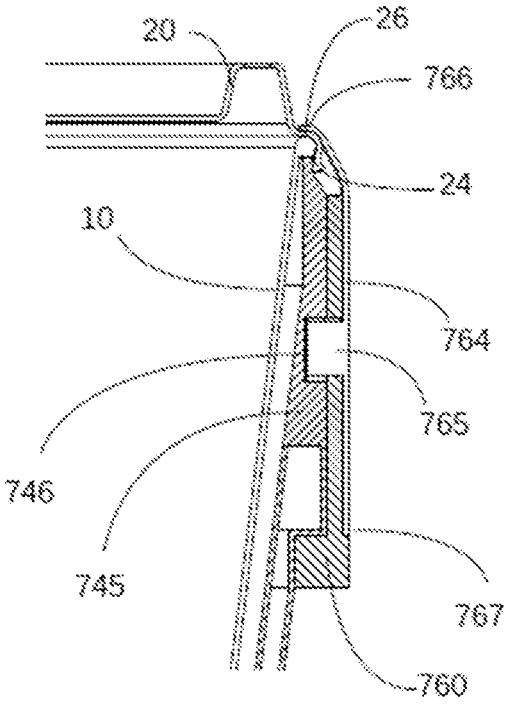
FIG. 18E shows a cross-section view of a portion of an insulating cup holder containing a disposable cup and lid with a retractable clamp mechanism in the locked position acting on the shoulder of the lid.
Figure 18C:
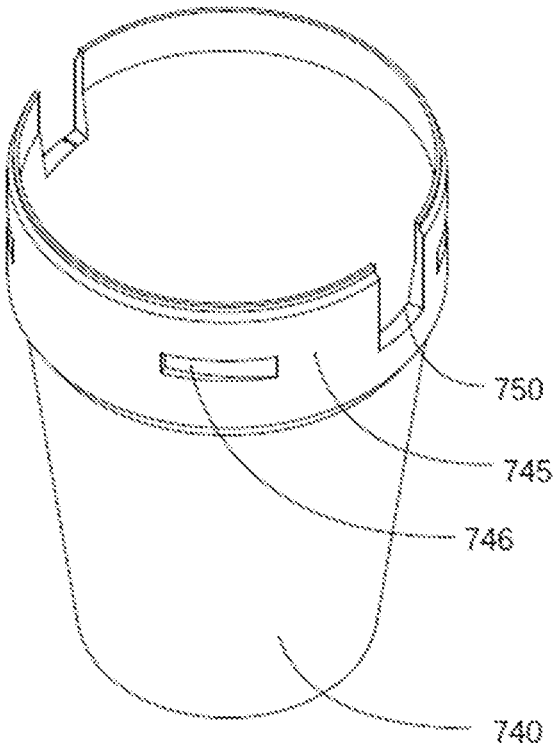
FIG. 18C shows a perspective view of an insulating cup holder having ramps to actuate a retractable clamp mechanism.
Figure 18F:
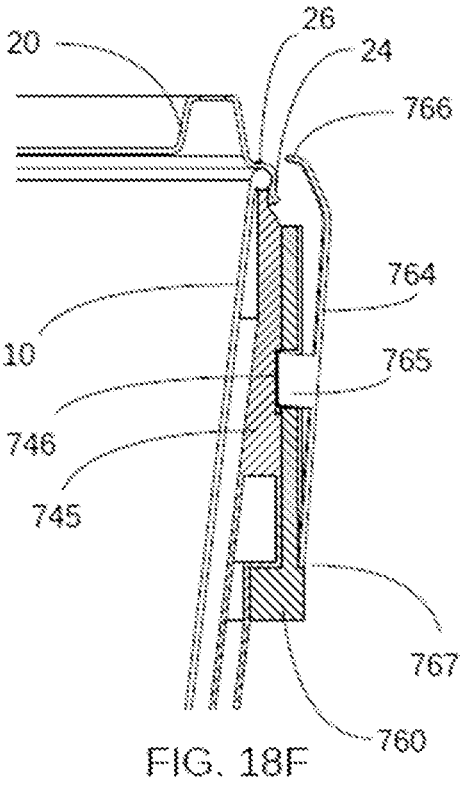
FIG. 18F shows a cross-section view of a portion of an insulating cup holder containing a disposable cup and lid with a retractable clamp mechanism in the open position.

According to examples as illustrated in FIGS. 18A through 18F, a beverage cup 10 with an attached lid 20 may be retained within beverage cup holder 740 by means of retractable clamps 764. In FIGS. 18A and 18E, clamps 764 are in the closed position, holding the beverage cup within cup holder 740, while in FIGS. 18B and 18F, clamps 764 are in the open position, allowing a beverage cup to be inserted into or removed from cup holder 740. In the embodiment illustrated in FIGS. 18A through 18F, retractable clamps 764 are actuated by means of a retaining-clamp actuator ring 760, in combination with ramps 746 in wall 745 of cup holder 740. As illustrated in FIG. 18C, cup holder 740 includes a set of ramps 746 in side wall 745. Clamp 764, as illustrated in FIG. 18D, includes a protrusion 765 configured to fit within ramp 746. Clamp 764 also includes a lobe 766 at the top configured to mate with top surface of shoulder 26 of lid 20 when clamp 764 is in the closed position. Finally, clamp 764 includes an attachment point 767 at which it is attached to retaining clamp actuator ring 760. Actuator ring 760 is permanently attached to cup holder 740 such that it may rotate around cup holder 740 on their common axis of cylindrical symmetry. Actuator ring includes recesses 763 to allow clamp 764 to sit flush with the surface of actuator ring 760 when clamp 764 is in the closed position. When actuator ring 760 is twisted with respect to cup holder 740, protrusion 765 of clamp 764 slides up ramp 746, causing clamp 764 to bend outward at attachment point 767 into the open position, allowing cup 10 with lid 20 to be removed from or inserted into cup holder 740. When actuator ring 760 is twisted in the opposite direction, protrusion 765 of clamp 764 slides down ramp 746, allowing clamp 764 to relax into the closed position, in which lobe 766 covers the top of shoulder 26 of lid 20, thereby retaining cup 10 with lid 20 in cup holder 740. Actuator ring 760 also includes a skirt 761 long enough to cover finger-sized slots 750 in cup holder 740. Skirt 761 further includes its own finger-sized slots 762 corresponding to finger-sized slots in cup holder 740 and aligned such that slots 762 will be offset from slots 750 when actuator ring 760 is rotated to place clamps 764 in the closed position and such that slots 762 will align with slots 750 when actuator ring 760 is rotated to place clamps 764 in the open position. Such alignment will ensure that beverage cup 10 is fully enclosed to minimize heat transfer when closed in cup holder 740, and that finger-sized slots are available for a user to hold beverage cup 10 as it is inserted into cup holder 740 when clamps 764 are open to allow such insertion.

Figure 11E:
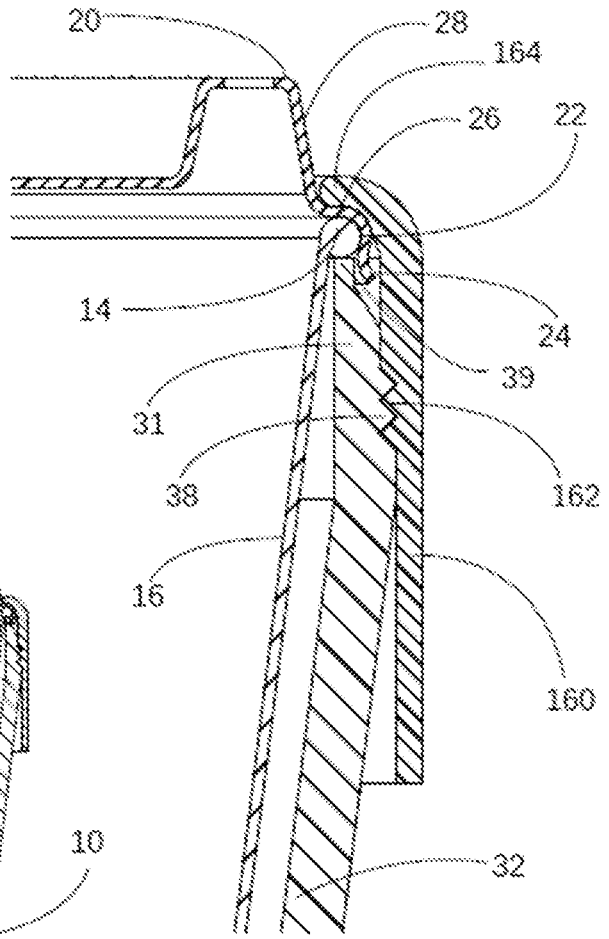
FIG. 11E shows a closeup of a portion of the cup holder, disposable cup, lid, and retaining ring of FIG. 11D.
Figure 11D:
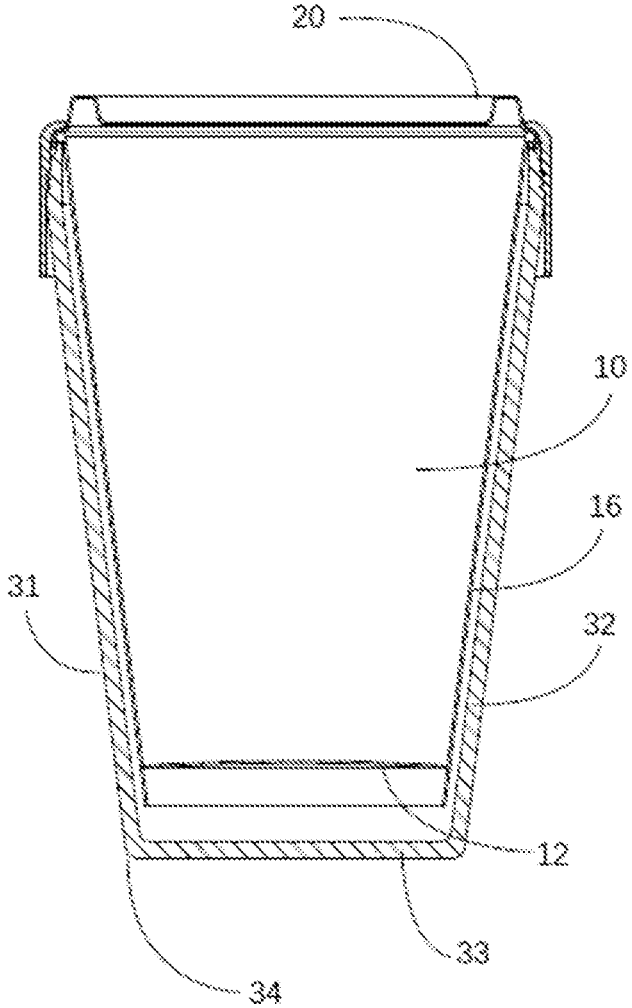
FIG. 11D shows a cross-section view of the cup holder, disposable cup, lid, and retaining ring of FIG. 11C.
Figure 19:
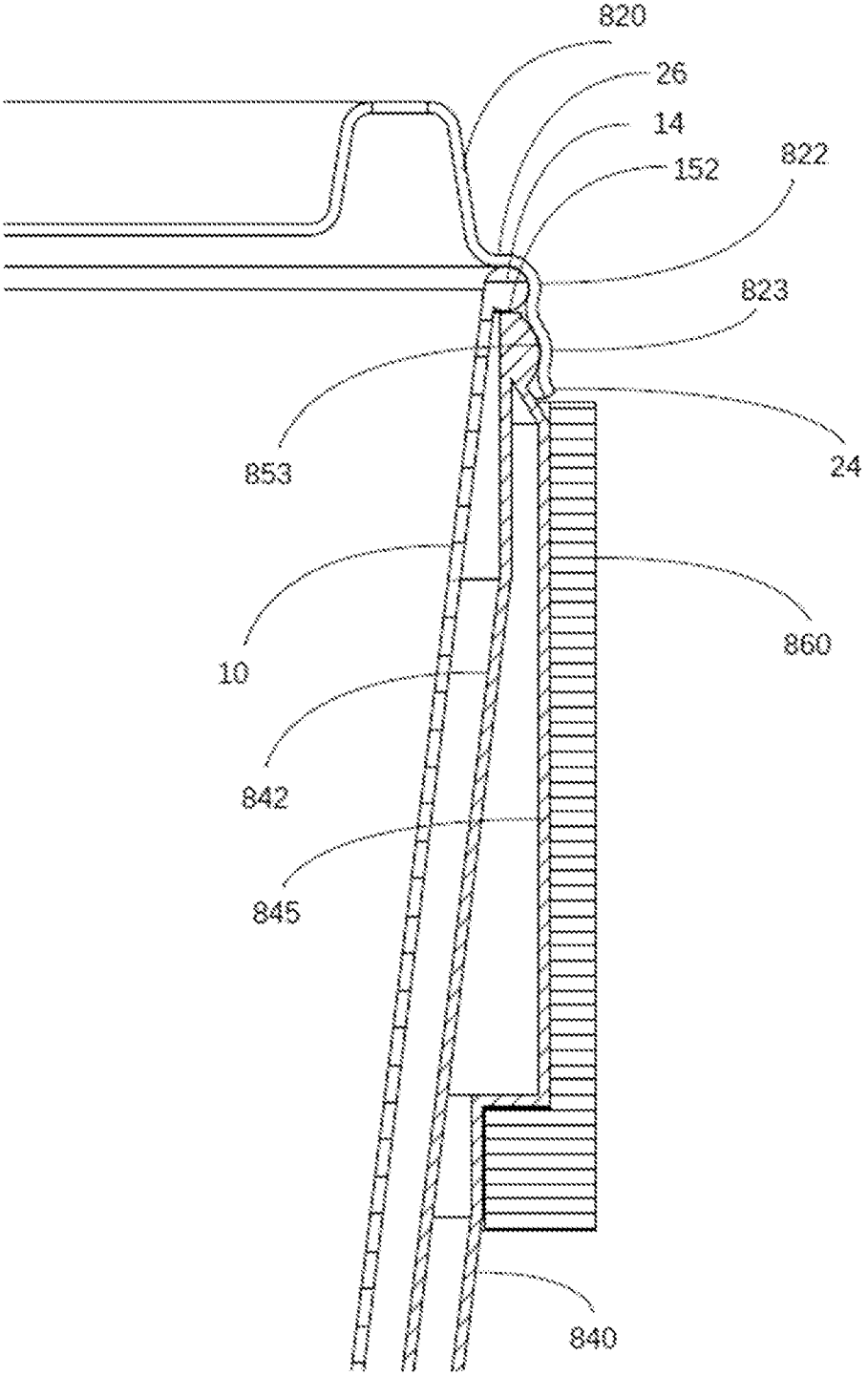
FIG. 19 shows a cross-section view of a portion of an insulating cup holder containing a disposable cup and lid with a snap fit between the lid and the cup holder.

According to examples as illustrated in FIG. 19, a beverage cup 10 is held within beverage cup holder 840 by means of a modified disposable beverage cup lid 820. A conventional disposable beverage cup 10 includes a radially-outwardly-extending peripheral bead 14, which provides a mating interface for a disposable lid 20 as illustrated, for example, in FIG. 11E. Also illustrated in FIG. 11E is a conventional disposable lid 20, which includes a radially-inwardly-opening circumferential groove 22 configured to mate through a snap fit with peripheral bead 14 of disposable cup 10, and a shoulder 26 that rests on the top of peripheral bead 14 when lid 20 is properly mated with disposable cup 10. Disposable lid 20 also includes a peripheral skirt 24 below circumferential groove 22, such that the skirt provides a guiding surface to assist in aligning the disposable lid for mating on bead 14 of disposable cup 10. In an embodiment, illustrated in FIG. 19, a disposable beverage cup lid 820 includes a first radially-inwardly-opening circumferential groove 822 configured to mate through a snap fit with peripheral bead 14 of disposable cup 10, and a second radially-inwardly-opening circumferential groove 823 displaced axially below first circumferential groove 822. Insulating cup holder 840 includes an inner wall 842 and an outer wall 845 that are joined together along their upper edges forming an upward-facing circular flange 152 along their top-most surfaces. As in other embodiments, circular flange 152 is sized to fit against peripheral bead 14, thereby supporting beverage cup 10 when it is installed in cup holder 840. Below flange 152, cup holder 840 includes a cup-holder peripheral bead 853. Cup-holder peripheral bead 853 is configured to mate through a snap fit with corresponding second radially-inwardly-opening circumferential groove 823 in disposable lid 820. Thus, disposable lid 820 provides a first snap-fit means for attachment to disposable cup 10 and a second snap-fit means for attachment to cup holder 840, thereby holding disposable cup 10 in cup holder 840. It will be appreciated that cup 10 may be inserted into cup holder 840 before lid 820 is attached to cup 10, with the lid 820 being applied after cup 10 is inserted, and secured by snap fit simultaneously to both cup 10 and cup holder 840. Alternatively, lid 820 may be fitted onto cup 10 before cup 10 is inserted into cup holder 840, in which case a downward force applied to shoulder 26 of lid 820 will cause it to attach by snap fit over bead 853 to cup holder 840. Although not illustrated here in the interest of brevity, it will further be appreciated that a user may more easily be able to insert beverage cup 10 into cup holder 840 if cup holder 840 includes finger sized gaps, as illustrated, for example, in FIGS. 12A through 12E, to allow user's fingers to maintain firm contact with the side wall of cup 10 as it is being inserted. It will further be appreciated that the user may prefer to close the finger-sized gaps after cup 10 is inserted into cup holder 840. As such, a rotatable ring 860 is provided such that corresponding gaps may be moved into position to either cover or uncover the finger-sized gaps in a manner analogous to that shown in FIGS. 18A and 18B.

Figure 20A:
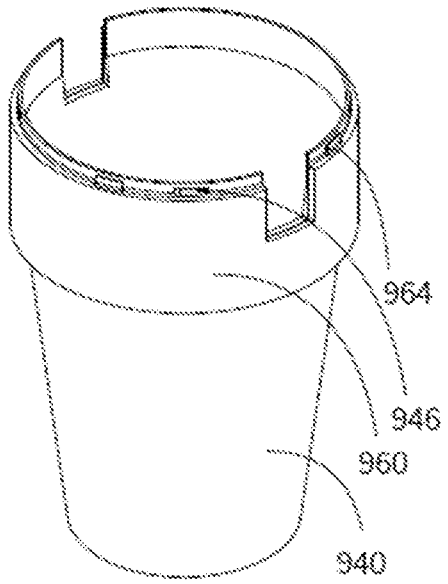
FIG. 20A shows a perspective view of an insulating cup holder having ramps to actuate a retractable clamp mechanism.
Figure 20C:
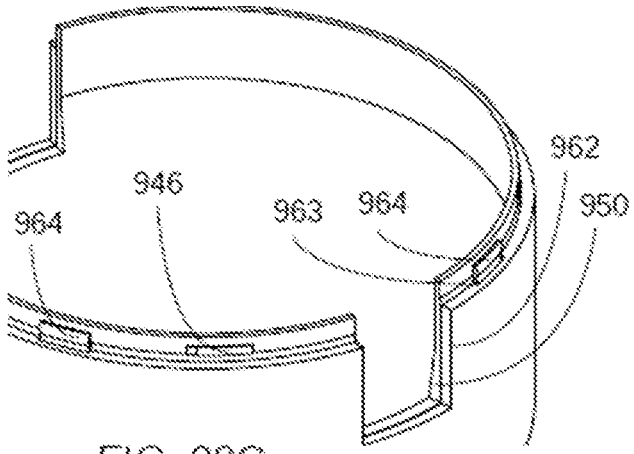
FIG. 20C shows a closeup perspective view of a portion of an insulating cup holder having ramps to actuate a retractable clamp mechanism, with the clamps in the unlocked position.
Figure 20D:
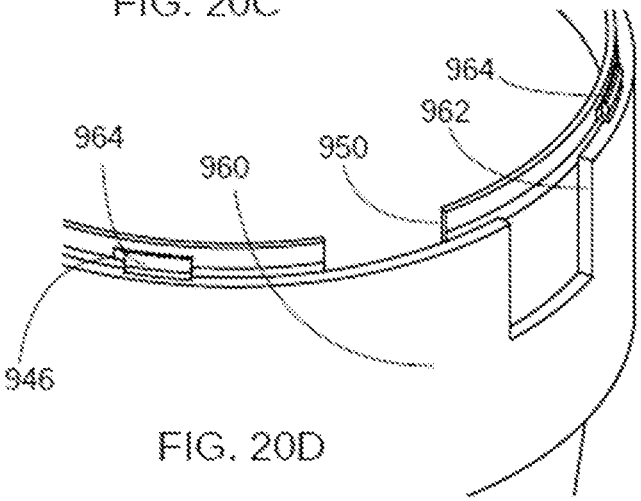
FIG. 20D shows a closeup perspective view of a portion of an insulating cup holder having ramps to actuate a retractable clamp mechanism, with the clamps in the locked position.
Figure 20B:
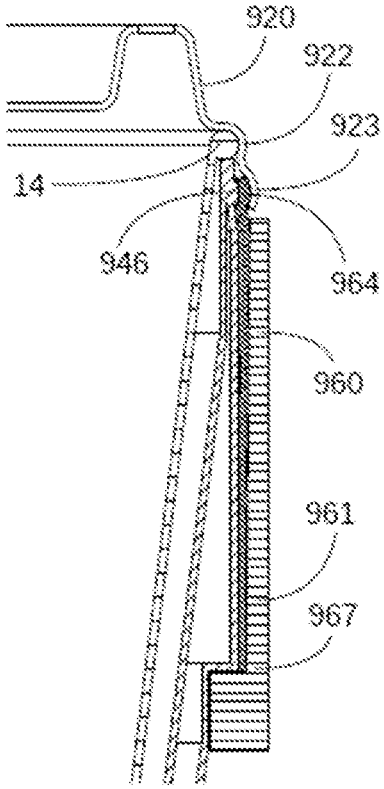
FIG. 20B shows a cross-section view of a portion of an insulating cup holder containing a disposable cup and lid with a retractable clamp mechanism in the locked position acting on the skirt of the lid.
Figure 20E:
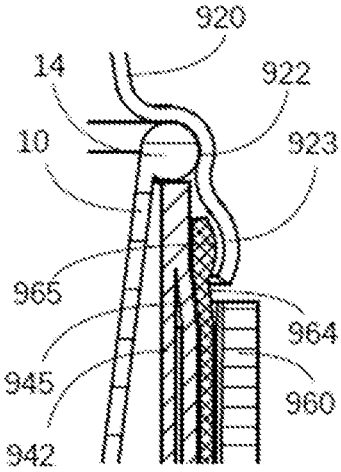
FIG. 20E shows a closeup cross-section view of a portion of an insulating cup holder containing a disposable cup and lid with a retractable clamp mechanism in the unlocked position.
Figure 20F:
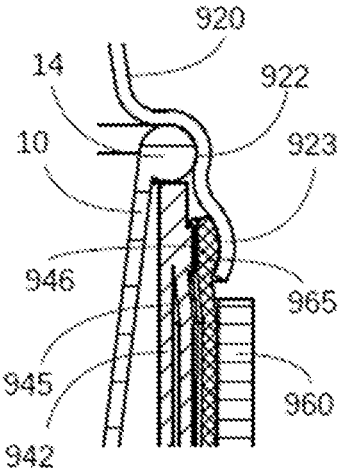
FIG. 20F shows a closeup cross-section view of a portion of an insulating cup holder containing a disposable cup and lid with a retractable clamp mechanism in the locked position acting on the skirt of the lid.

According to examples as illustrated in FIGS. 20A through 20F, a beverage cup 10 is held within beverage cup holder 940 by means of a modified disposable beverage cup lid 920 combined with a retractable clamp 964. As in the embodiment illustrated in FIG. 19, disposable beverage cup lid 920 includes a first radially-inwardly-opening circumferential groove 922 configured to mate through a snap fit with peripheral bead 14 of disposable cup 10, and a second radially-inwardly-opening circumferential groove 923 below circumferential groove 922. Insulating cup holder 940 includes a plurality of retractable retraining clamps 964 configured to be retracted when retaining-clamp actuator ring 960 is rotated in one direction and extended when retaining-clamp actuator ring 960 is rotated in the opposite direction. In the embodiment illustrated in FIGS. 20A through 20F, cup holder 940 includes a plurality of radially-extending ramps 946 located near the upper perimeter. Retaining clamps 964 are attached at attachment point 967 to retaining-clamp actuator ring 960 and move with ring 960 as it is twisted around cup holder 940. The upper ends of clamps 964 slide against the surface of cup holder 940 near its upper end as actuator ring 960 is twisted. When actuator ring 960 is twisted to a position, as indicated in FIGS. 20D and 20F, where clamps 964 move over ramps 946, the upper ends of clamps 964 are pushed radially outward to a position where they will engage with second circumferential groove 923 of lid 920, thereby retaining lid 920 and, by extension, cup 10 in cup holder 940. When actuator ring 960 is twisted to a position, as indicated in FIGS. 20C and 20E, where clamps 964 are not in contact with ramps 946, the upper ends of clamps 964 retract radially inward sufficiently to disengage with circumferential groove 923, thereby releasing lid 920 and cup 10 from cup holder 940. As illustrated in FIGS. 20A through 20F, the profile of the upper face of clamps 964 has been selected to match the profile of circumferential groove 923 to provide mechanical contact between the surfaces. It will be appreciated that, while a curved profile was selected for illustration purposes in these figures, alternative profiles, such as triangular or rectangular, may provide an improved mechanical contact for the purpose of holding lid 920 and cup 10 in cup holder 940. Actuator ring 960 also includes a skirt 961 long enough to cover finger-sized slots 950 in cup holder 940. Skirt 961 further includes its own finger-sized slots 962 corresponding to finger-sized slots in cup holder 940 and aligned such that slots 962 will be offset from slots 950 when actuator ring 960 is rotated to place clamps 964 in the closed position, and such that slots 962 will align with slots 950 when actuator ring 960 is rotated to place clamps 964 in the open position. Such alignment will ensure that beverage cup 10 is fully enclosed to minimize heat transfer when closed in cup holder 940, and that finger-sized slots are available for a user to easily insert a beverage cup 10 into cup holder 940 when clamps 964 are open to allow such insertion.

Figure 21A:
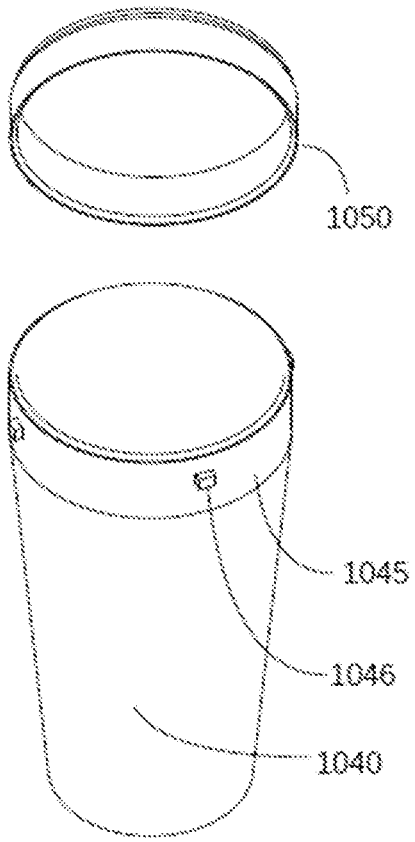
FIG. 21A shows a perspective view of an insulating cup holder and a cup support ring.
Figure 21B:
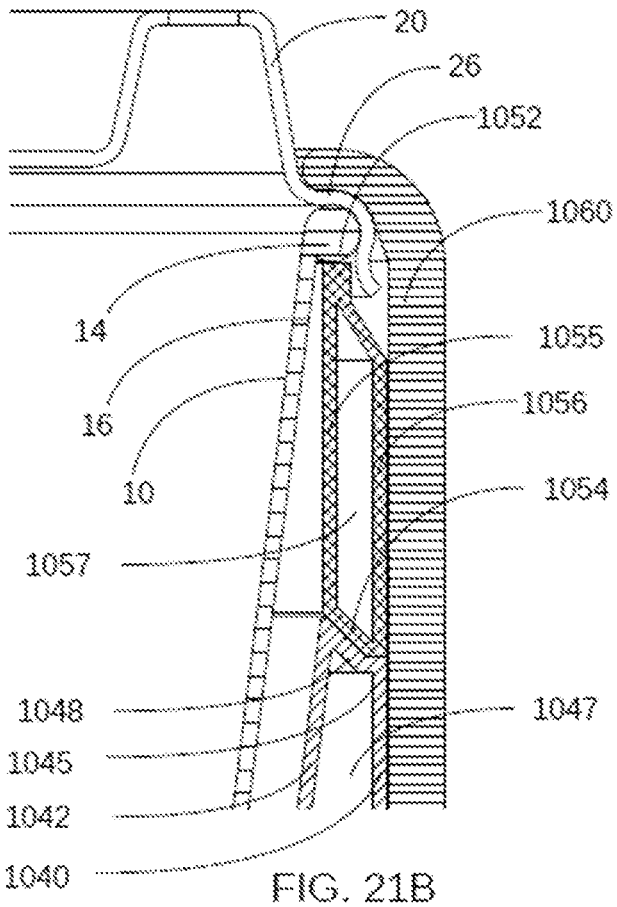
FIG. 21B shows a cross-section view of a portion of an insulating cup holder with a cup support ring and twist-lock retaining ring and containing a disposable cup and lid.
Figures 21C, 21D, 21E, 21F, 21G:
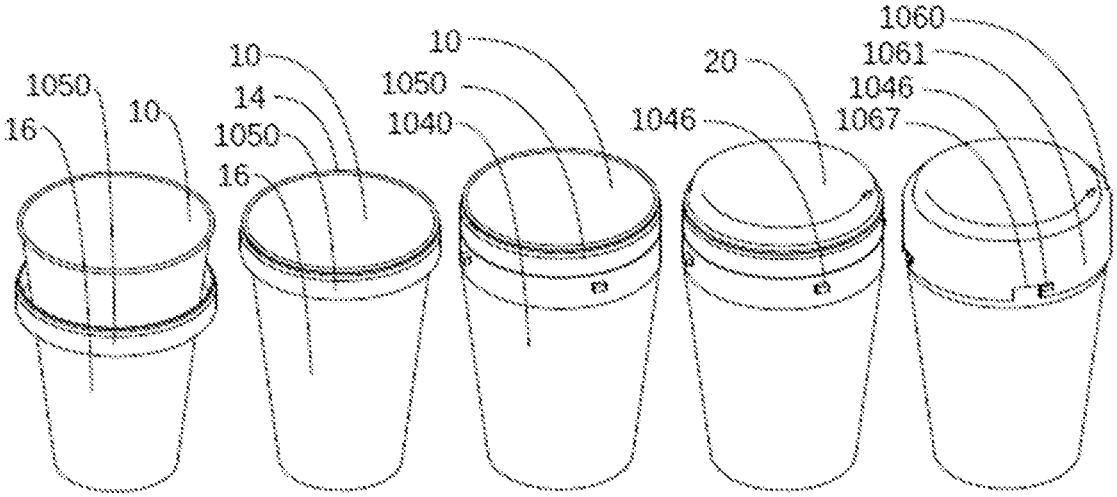
FIG. 21C shows a perspective view of a disposable cup partially inserted into a cup support ring.
FIG. 21D shows a perspective view of a disposable cup fully inserted into a cup support ring.
FIG. 21E shows a perspective view of a disposable cup in a cup support ring inserted into an insulating cup holder.
FIG. 21F shows a perspective view of a disposable cup with a lid in a cup support ring inserted into an insulating cup holder.
FIG. 21G shows a perspective view of a disposable cup with a lid in a cup support ring inserted into an insulating cup holder and held in place with a twist-lock retaining ring.

According to some examples provided herein, such as described with reference to FIGS. 4A-4F, 5A-5B, 6A-6D, 7A-7D, 8A-8F, 9C-9D, 10A-10C, 12A-12E, 13A-13E, 15A-15C, 16A-16C, 17A-17C, 18A-18F, 20A-20F, 22A-22F, 23, and 24, the side wall and flange of the cup holder may include two or more gaps sized to allow a user to hold a beverage cup with two or more fingers while inserting the beverage cup into the cup holder. According to examples as illustrated in FIGS. 21A through 21G, insertion is facilitated through the use of a cup support ring 1050 configured to act as a spacer between cup holder 1040 and beverage cup 10. Cup support ring includes at its top an upward-facing circular flange 1052. The inner diameter of the upward-facing flange 1052 is preferably not smaller than the diameter of side wall 16 of disposable beverage cup 10 at the level of the bottom of bead 14 but not larger than the diameter of the circle formed by the lower-most edge of bead 14. Cup support ring 1050 further includes a lower face 1054 configured to mate with an upper face 1048 of cup holder 1040. As illustrated in FIG. 21B, these two faces may be conical in shape to provide an interface that will ensure stable centering when cup support ring 1050 is stacked on top of cup holder 1040. Cup holder 1040 may be of solid construction or may, as illustrated in FIG. 21B, include an inner wall 1042 and an outer wall 1045 enclosing an insulating space 1047. Similarly, cup support ring 1050 may be of solid construction or may, as illustrated in FIG. 21B, include an inner wall 1055 and an outer wall 1056 enclosing an insulating space 1057. The vertical height of cup support ring 1050 is preferably large enough to provide easy grip between thumb and fingers when held by its outer wall 1056, but small enough that it can be easily covered by skirt 1061 of retaining ring 1060. Cup support ring 1050 facilitates insertion of beverage container 10 into cup holder 1040 through a sequence of steps as illustrated in FIGS. 21C through 10*g*. In FIG. 21C, beverage container 10 is inserted into cup support ring 1050. Because the height of cup support ring 1050 is much shorter than the height of beverage cup 10, the user may maintain contact with wall 16 of cup 10 as it is being inserted into ring 1050. In FIG. 21D, ring 1050 is lifted to a point where it makes contact with bead 14, at which point the user may securely lift and hold beverage cup 10 by grasping only ring 1050 and without need to touch side wall 16. In FIG. 21E, beverage cup 10 is inserted into cup holder 1040 while user holds support ring 1050. In FIG. 21F, lid 20 is applied to cover cup 10. In FIG. 21G, retaining ring 1060 is used to secure the beverage cup in holder 1040 by means of a rotary clamping action analogous to that previously illustrated in FIGS. 16A through 16C. As seen in FIGS. 21A, 21E, 21F, and 21G, cup holder 1040 includes a set of protrusions 1046 extending radially outward from outer wall 1045. As seen in FIG. 21G, retaining ring 1060 includes a matching set of slots 1067 in the bottom of retaining ring skirt 1061. Retaining ring 1060 may be secured to cup holder 1040 by sliding slots 1067 over protrusions 1046 and twisting retaining ring 1060 to lock slots 1067 over protrusions 1046 as illustrated in FIG. 21G. Although a rotary clamping means is used to secure retaining ring 1060 to cup holder 1040 in the embodiment illustrated in FIGS. 21A through 21G, it will be appreciated that alternative means, such as those previously illustrated, may be used to secure a retaining ring to a cup holder when using a cup support ring. Regardless of the means used to secure retaining ring 1060 to cup holder 1040, when fully assembled, as illustrated in FIG. 21B, retaining ring 1060 provides a downward force on shoulder 26 of lid 20 and successively through bead 14 of cup 10, cup support ring 1050, to cup holder 1040, thereby creating a stable assembly and securely holding cup 10 in cup holder 1040.

Figure 22A:
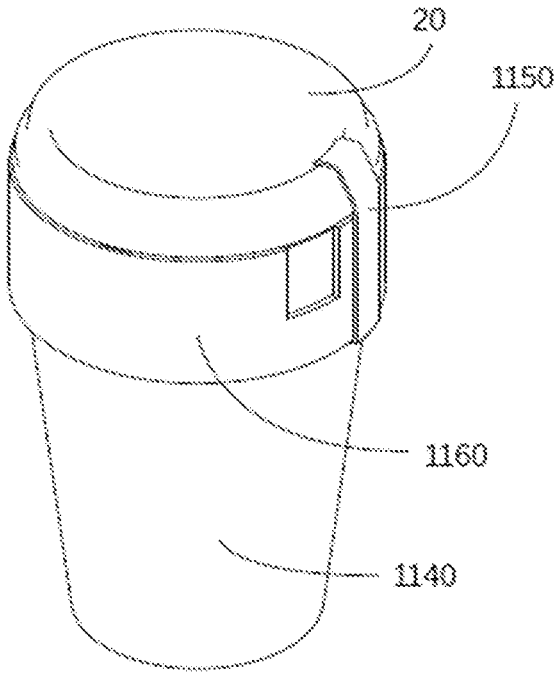
FIG. 22A shows a perspective view of a disposable cup with a lid in an insulating cup holder with a drinking port cover in the closed position.
Figure 22B:
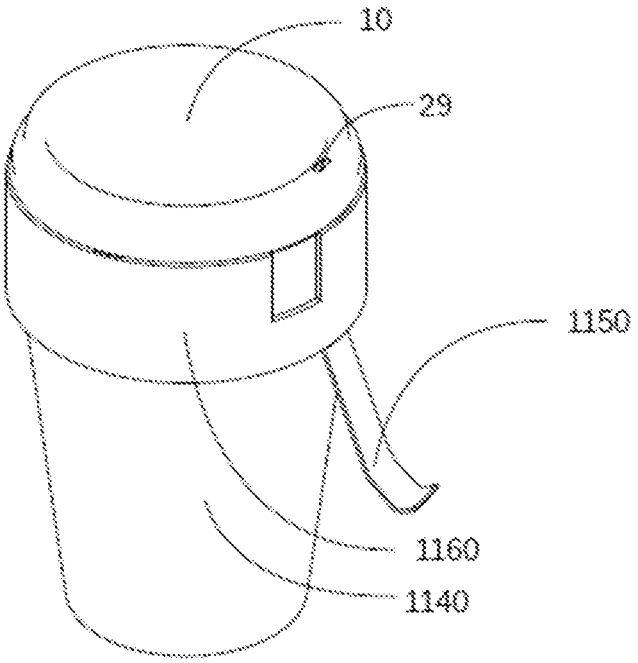
FIG. 22B shows a perspective view of a disposable cup with a lid in an insulating cup holder with a drinking port cover in the open position.
Figure 22C:
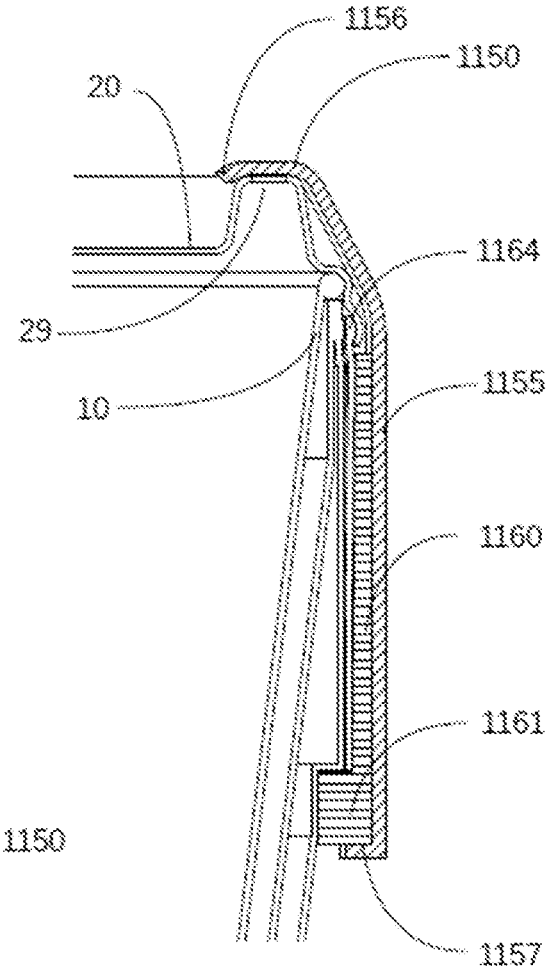
FIG. 22C shows a cross-section view of a portion of a disposable cup with a lid in an insulating cup holder with a drinking port cover in the closed position.

According to examples described herein, the present invention will secure a disposable beverage cup within an insulating cup holder to minimize the chance of a spill. In embodiments described above, a cup with an attached lid is securely held in an insulating cup holder by various means, and if the cup holder should accidentally be overturned, the cup and lid will remain in the holder and the lid will remain on the cup, preventing an instant spill. However, disposable beverage cup lids typically have a drinking port, which could allow a slow spill of a beverage from an overturned beverage cup holder even when the cup and lid remain securely held within the cup holder. This possibility can be reduced by including a drinking port cover capable of sealing the drinking port when not in use. According to examples illustrated in FIGS. 22A, 22B, and 22C, a drinking port cover 1150 is provided to alternately cover or uncover drinking port 29 in lid 20 when a disposable beverage cup 10 is secured within insulating cup holder 1140. In this embodiment, beverage cup 10 with lid 20 is secured in insulating cup holder 1140 by means of retractable clamps 1164 as previously illustrated in FIGS. 20A through 20F. It will be appreciated that this means of securing the beverage cup in the insulating cup holder was selected here for illustration purposes and that a drinking port cover as described here may be combined with other means for securing a beverage cup in an insulating cup holder as described in various embodiments above. According to examples illustrated in FIGS. 22A, 22B, and 22C, drinking port cover 1150 includes a rigid hook 1156 shaped to match the contour of disposable lid 20 around drinking port 29, an attachment means 1157 to secure it to retaining clamp actuator ring 1160 and a flexible stem 1155 that may stretch to allow hook 1156 to be pulled over lid 20 to cover port 29. When hook 20 is placed over port 29 as indicated in FIGS. 22A and 22C, flexible stem 1155 is stretched beyond its relaxed position and so provides a downward force to hold hook 1156 over port 29. When port cover 1150 is removed to expose port 29 for drinking, port cover 1150 remains attached to actuator ring 1160 as indicated in FIG. 22B. It will be appreciated that the attachment between cover 1150 and actuator ring 1160 illustrated in FIGS. 22A, 22B, and 22C was selected for illustration purposes and that in other embodiments drinking port cover 1150 may instead be attached to insulating cup holder 1140.

Figure 23:
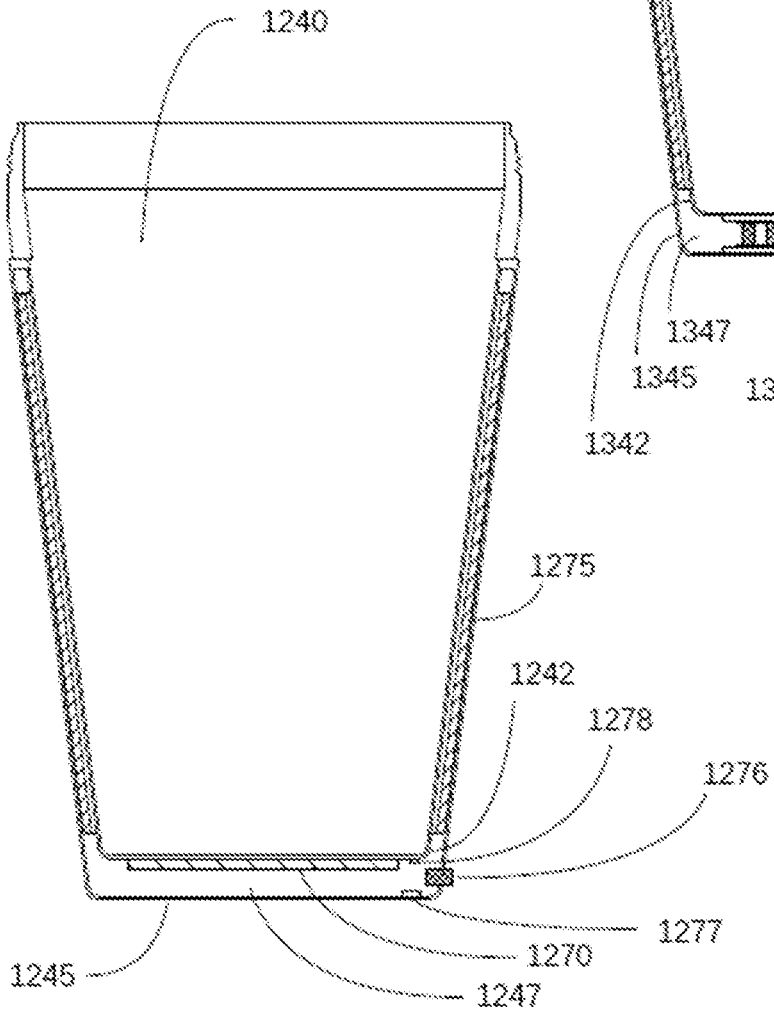
FIG. 23 shows a cross-section view of an insulating cup holder with an electric resistance heater.

An object of the present invention is to provide a means for holding a disposable beverage cup and minimizing heat transfer between the beverage cup and the surrounding environment in order to maintain its contents at a temperature preferred for drinking. It will be appreciated that, while various forms of insulation may reduce heat transfer, no insulation system is perfect and the temperature of a beverage contained within an insulating cup holder will gradually approach the temperature of the environment. In an example as illustrated in FIG. 23, the time period over which a hot beverage may be maintained at a temperature above the temperature of the environment may be extended by use of an electrical resistance heating element 1270 attached to inner wall 1242 of insulating cup holder 1240. In this embodiment, power for heating element 1270 is provided by battery 1275, which is contained in insulating space 1247 between inner wall 1242 and outer wall 1245 of insulating cup holder 1240. Battery 1275 may be recharged through charging port 1276. The temperature of inner wall 1242 is measured by temperature sensor 1278 and power to heating element 1270 is controlled by controller 1277 which monitors temperature sensor 1278 and applies power to heating element 1270 when the temperature of inner wall 1242 falls below a setpoint defining the preferred temperature of the beverage contained in insulating cup holder 1240. The temperature may be selected by the user by various means (not shown) including by wired connection during battery charging, by temperature selection controls on the external surface of cup holder 1240, or by wireless means through, for example, a smartphone application.

Figure 24:
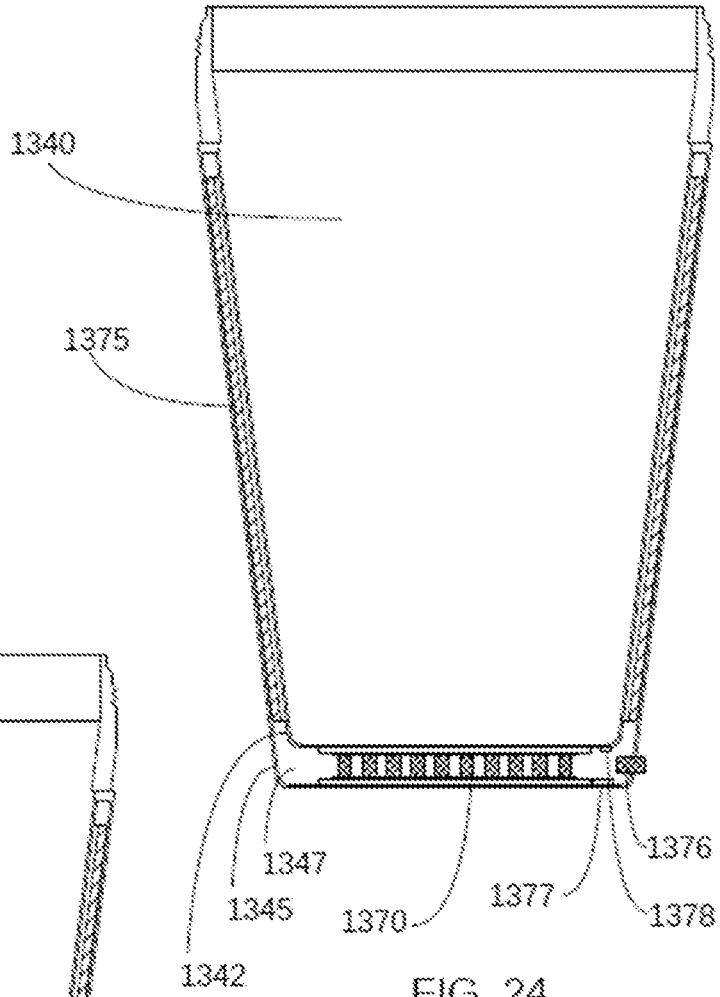
FIG. 24 shows a cross-section view of an insulating cup holder with a thermoelectric temperature-control module.

In another example as illustrated in FIG. 24, the temperature of the interior of insulating beverage cup holder 1340 is controlled through the use of a thermoelectric element 1370 that connects to, and transfers heat between, inner wall 1342 and outer wall 1345. A thermoelectric element may allow heat transfer in either direction, thereby making it possible to maintain the temperature of the interior of cup holder 1340 either above or below the temperature of the environment. In this embodiment, power for thermoelectric element 1370 is provided by battery 1375 which is contained in insulating space 1347 between inner wall 1342 and outer wall 1345 of insulating cup holder 1340. Battery 1375 may be recharged through charging port 1376. The temperature of inner wall 1342 is measured by temperature sensor 1378 and power to thermoelectric element 1370 is controlled by controller 1377 which monitors temperature sensor 1378 and applies power to thermoelectric element 1370 to either heat inner wall 1342 when the temperature of inner wall 1342 falls below a setpoint defining a preferred temperature of a hot beverage contained in insulating cup holder 1340, or to cool inner wall 1342 when the temperature of inner wall 1342 rises above a setpoint defining a preferred temperature of a cold beverage contained in insulating cup holder 1340. The temperature may be selected by the user by various means (not shown) including by wired connection during battery charging, by temperature selection controls on the external surface of cup holder 1340, or by wireless means through, for example, a smartphone application.

The various components described herein can be combined to produce an insulating cup holder that will provide a secure support for a disposable beverage cup with a lid, provide a method for simple and secure insertion of a disposable beverage cup with or without a lid into the beverage cup holder, provide a means for maintaining the beverage in the cup at or near a preferred temperature, and provide a means for reducing or minimizing the potential for spilling a beverage contained in the beverage cup. It will be readily understood by practitioners in the art that the components of the various examples as described above may be combined in a variety of configurations, and that not all of the features of the present invention need be combined in in any single example provided herein. It will further be understood that the insulating beverage cup holder may be manufactured using any of a variety of materials including, for example, plastics and metals, within the intent of this invention. While the intent of this invention is to provide a means for securely holding a conventional disposable beverage cup with a lid, and controlling heat flow to and from a beverage contained in the cup, it will further be understood that the invention may be used with a non-disposable beverage cup and/or lid fabricated in the shape of a conventional disposable beverage cup and/or lid but fabricated from more durable and/or washable materials, for example, plastics and metals, within the intent of this invention.

This invention has been described in its currently contemplated best embodiment, and it is clear that it is susceptible to numerous modifications, modes, and embodiments within the ability of those skilled in the art and without the exercise of the inventive faculty.

Accordingly, the scope of this invention is defined by the scope of the following claims.

What is claimed is:

1. An assembly for holding a beverage cup, the assembly comprising:

a cup holder comprising a closed bottom, a generally cylindrical or frustoconical side wall, and an upper access opening configured to receive the beverage cup, wherein an outer surface of the side wall of the cup holder comprises at least one latch-engagement feature; and a lid comprising a skirt, first and second latches, and first and second hinges respectively movably coupling the first and second latches to the skirt, wherein the lid is couplable to the cup holder by engaging the first and second latches with the at least one latch-engagement feature and is removable from the cup holder by disengaging the first and second latches from the at least one latch-engagement feature.

2. The assembly of claim 1, wherein the at least one latch-engagement feature comprises at least one recess.

3. The assembly of claim 2, wherein the at least one recess is downward-facing.

4. The assembly of claim 2, wherein the first and second latches comprise first and second latch hooks that respectively insert into the at least one recess.

5. The assembly of claim 1, wherein the at least one latch-engagement feature encircles the cup holder and is configured to be engaged by both the first and second latches.

6. The assembly of claim 1, wherein the at least one latch-engagement feature is segmented and comprises first and second segments that are configured to be respectively engaged by the first and second latches.

7. The assembly of claim 1, wherein the side wall of the cup holder includes first and second gaps sized to allow a user to hold the beverage cup with first and second fingers while inserting the beverage cup into the cup holder.

8. The assembly of claim 7, wherein the first and second latches respectively cover the first and second gaps when the lid is coupled to the cup holder.

9. The assembly of claim 7, wherein the skirt comprises first and second skirt extensions that respectively cover the first and second gaps when the lid is coupled to the cup holder.

10. The assembly of claim 7, wherein the side wall of the cup holder further includes a third gap sized to allow a user to further hold the beverage cup with a third finger while inserting the beverage cup into the cup holder.

11. The assembly of claim 7, wherein the first gap is larger than the second gap.

12. The assembly of claim 1, wherein the first and second hinges comprise living hinges.

13. A lid for use with a cup holder, the lid comprising:

a skirt;

first and second latches; and first and second hinges respectively movably coupling the first and second latches to the skirt, wherein the lid is couplable to the cup holder by engaging the first and second latches with at least one latch-engagement feature of the cup holder and is removable from the cup holder by disengaging the first and second latches from the at least one latch-engagement feature.

14. The lid of claim 13, wherein the at least one latch-engagement feature comprises at least one recess, and wherein the first and second latches comprise first and second latch hooks that respectively insert into the at least one recess.

15. The lid of claim 13, wherein the side wall of the cup holder includes first and second gaps sized to allow a user to hold the beverage cup with first and second fingers while inserting the beverage cup into the cup holder, wherein the first and second latches respectively are configured to cover the first and second gaps when the lid is coupled to the cup holder.

16. The lid of claim 13, wherein the side wall of the cup holder includes first and second gaps sized to allow a user to hold the beverage cup with first and second fingers while inserting the beverage cup into the cup holder, wherein the skirt comprises first and second skirt extensions that respectively are configured to cover the first and second gaps when the lid is coupled to the cup holder.

17. The lid of claim 13, wherein the first and second hinges comprise living hinges.

* * * * *